US008475905B2

(12) United States Patent
Abrams

(10) Patent No.: US 8,475,905 B2
(45) Date of Patent: Jul. 2, 2013

(54) SUBLIMATION DYE PRINTED TEXTILE

(75) Inventor: Louis Brown Abrams, Fort Collins, CO (US)

(73) Assignee: High Voltage Graphics, Inc, Fort Collins, CO (US)

( * ) Notice: Subject to any disclaimer, the term of this patent is extended or adjusted under 35 U.S.C. 154(b) by 537 days.

(21) Appl. No.: 12/031,445

(22) Filed: Feb. 14, 2008

(65) Prior Publication Data

US 2009/0075075 A1 Mar. 19, 2009

(51) Int. Cl.

| | |
|---|---|
| ***B32B 3/02*** | (2006.01) |
| ***D03D 13/00*** | (2006.01) |
| ***D03D 15/00*** | (2006.01) |

(52) U.S. Cl.

USPC ..... 428/90; 428/88; 428/343; 442/203; 442/286; 442/149

(58) Field of Classification Search

USPC ..... 442/181, 149, 164, 203, 286; 428/354, 428/343, 90, 88; 8/471; 156/230, 235, 220

See application file for complete search history.

(56) References Cited

U.S. PATENT DOCUMENTS

| | | | |
|---|---|---|---|
| 1,580,717 | A | 4/1926 | Flick |
| 1,905,989 | A | 4/1933 | Safir et al. |
| 1,975,542 | A | 10/1934 | Forsdale |
| 1,992,676 | A | 2/1935 | Schwarz |
| 2,047,978 | A | 7/1936 | Maclaurin |
| 2,096,750 | A | 10/1937 | Lawrence |
| 2,230,654 | A | 2/1941 | Plunkett |
| 2,275,617 | A | 3/1942 | Duerr et al. |
| 2,278,227 | A | 3/1942 | Thackeray et al. |
| 2,477,912 | A | 8/1949 | Vallandigham |
| 2,592,602 | A | 4/1952 | Saks |
| 2,636,837 | A | 4/1953 | Summers |
| 2,835,576 | A | 5/1958 | Ensink |
| 2,916,403 | A | 12/1959 | Calderwood |
| 2,981,588 | A | 4/1961 | Hyman |
| 2,999,763 | A | 9/1961 | Sommer |
| 3,099,514 | A | 7/1963 | Haber |
| 3,215,584 | A | 11/1965 | McConnell et al. |
| 3,314,845 | A | 4/1967 | Perri |
| 3,351,479 | A | 11/1967 | Fairchild |
| 3,377,232 | A | 4/1968 | Mencock et al. |
| 3,411,156 | A | 11/1968 | Feher |
| 3,432,446 | A | 3/1969 | Coppeta |

(Continued)

FOREIGN PATENT DOCUMENTS

| | | |
|---|---|---|
| AU | 606651 | 2/1991 |
| AU | 653994 | 10/1994 |

(Continued)

OTHER PUBLICATIONS

"PolyOne—OnFlexTM-S EH Economy Grades (High Density)", PolyOne® Corporation 2007, pp. 1-2.

(Continued)

*Primary Examiner* — Cheryl Juska
(74) *Attorney, Agent, or Firm* — Sheridan Ross PC

(57) ABSTRACT

The present invention is directed to an unstitched design having the appearance of being stitched or embroidered. A stitched design is digitally imaged, and the digital image used to control dye sublimation printing of a representation of the image onto a desired surface. In one configuration, the surface is a woven textile.

61 Claims, 10 Drawing Sheets

U.S. PATENT DOCUMENTS

| | | | | |
|---|---|---|---|---|
| 3,444,732 | A | | 5/1969 | Robbins et al. |
| 3,459,579 | A | | 8/1969 | Newman |
| 3,496,054 | A | | 2/1970 | Baigas |
| 3,529,986 | A | | 9/1970 | Kappas et al. |
| 3,565,742 | A | | 2/1971 | Stephens et al. |
| 3,591,401 | A | | 7/1971 | Snyder et al. |
| 3,622,434 | A | | 11/1971 | Newman |
| 3,630,990 | A | | 12/1971 | Neal |
| 3,639,149 | A | | 2/1972 | Spalding |
| 3,644,267 | A | | 2/1972 | Jackson, Jr. et al. |
| 3,657,060 | A | | 4/1972 | Haigh |
| 3,660,200 | A | | 5/1972 | Anderson et al. |
| 3,674,611 | A | | 7/1972 | Petry et al. |
| 3,734,813 | A | | 5/1973 | Pohl |
| 3,772,132 | A | | 11/1973 | Dulin, Jr. |
| 3,775,205 | A | | 11/1973 | Hermann et al. |
| 3,793,050 | A | | 2/1974 | Mumpower, Jr. |
| 3,803,453 | A | | 4/1974 | Hull |
| 3,816,211 | A | | 6/1974 | Haigh |
| 3,837,893 | A | | 9/1974 | Schoots |
| 3,837,946 | A | | 9/1974 | Gribbin |
| 3,887,737 | A | | 6/1975 | Baxter et al. |
| 3,900,676 | A | | 8/1975 | Alderson |
| 3,903,331 | A | | 9/1975 | Klein |
| 3,905,863 | A | | 9/1975 | Ayers |
| 3,917,883 | A | | 11/1975 | Jepson |
| 3,918,895 | A | | 11/1975 | Mizuno |
| 3,928,706 | A | | 12/1975 | Gibbons |
| 3,936,554 | A | | 2/1976 | Squier |
| 3,953,566 | A | | 4/1976 | Gore |
| 3,956,552 | A | | 5/1976 | Geary |
| 3,961,116 | A | | 6/1976 | Klein |
| 3,969,559 | A | | 7/1976 | Boe |
| 3,979,538 | A | | 9/1976 | Gilman et al. |
| 3,989,869 | A | | 11/1976 | Neumaier et al. |
| 4,018,956 | A | | 4/1977 | Casey |
| 4,025,678 | A | | 5/1977 | Frank |
| 4,031,281 | A | | 6/1977 | Keeling |
| 4,034,134 | A | | 7/1977 | Gregorian et al. |
| 4,035,532 | A | | 7/1977 | Gregorian et al. |
| 4,062,992 | A | | 12/1977 | Power et al. |
| 4,088,708 | A | | 5/1978 | Riew |
| 4,098,946 | A | | 7/1978 | Fuzek |
| 4,102,562 | A | | 7/1978 | Harper et al. |
| 4,104,439 | A | | 8/1978 | Fuzek |
| 4,110,301 | A | | 8/1978 | Zannucci et al. |
| 4,120,713 | A | | 10/1978 | Jensen et al. |
| 4,142,929 | A | | 3/1979 | Otomine et al. |
| 4,160,851 | A | | 7/1979 | Lienert et al. |
| 4,201,810 | A | | 5/1980 | Higashiguchi |
| 4,216,281 | A | | 8/1980 | O'Rell et al. |
| 4,218,501 | A | | 8/1980 | Kameya et al. |
| 4,228,225 | A | | 10/1980 | O'Rell et al. |
| 4,238,190 | A | | 12/1980 | Rejto |
| 4,251,427 | A | | 2/1981 | Recker et al. |
| 4,263,373 | A | | 4/1981 | McCaskey et al. |
| 4,264,691 | A | | 4/1981 | O'Rell et al. |
| 4,265,985 | A | | 5/1981 | O'Rell et al. |
| 4,269,885 | A | | 5/1981 | Mahn |
| 4,273,817 | A | * | 6/1981 | Matsuo et al. ..... 428/90 |
| 4,282,278 | A | | 8/1981 | Higashiguchi |
| 4,288,225 | A | | 9/1981 | Roland et al. |
| 4,292,100 | A | | 9/1981 | Higashiguchi |
| 4,294,577 | A | | 10/1981 | Bernard |
| 4,294,641 | A | | 10/1981 | Reed et al. |
| 4,299,015 | A | | 11/1981 | Marcus et al. |
| 4,308,296 | A | | 12/1981 | Chitouras |
| 4,314,813 | A | | 2/1982 | Masaki |
| 4,314,955 | A | | 2/1982 | Boden et al. |
| 4,319,942 | A | | 3/1982 | Brenner |
| 4,330,602 | A | | 5/1982 | O'Rell et al. |
| 4,340,632 | A | | 7/1982 | Wells et al. |
| 4,352,924 | A | | 10/1982 | Wooten et al. |
| 4,362,773 | A | | 12/1982 | Shikinami |
| 4,368,231 | A | | 1/1983 | Egert et al. |
| 4,369,157 | A | | 1/1983 | Conner |
| 4,370,374 | A | | 1/1983 | Raabe et al. |
| 4,385,093 | A | | 5/1983 | Hubis |
| 4,385,588 | A | | 5/1983 | Bennetot |
| 4,387,214 | A | | 6/1983 | Passmore et al. |
| 4,388,134 | A | | 6/1983 | Long et al. |
| 4,390,387 | A | * | 6/1983 | Mahn ..... 428/90 |
| 4,396,662 | A | | 8/1983 | Higashiguchi |
| 4,405,401 | A | | 9/1983 | Stahl |
| 4,413,019 | A | | 11/1983 | Brenner |
| 4,418,106 | A | | 11/1983 | Landler et al. |
| 4,423,106 | A | | 12/1983 | Mahn |
| 4,425,268 | A | | 1/1984 | Cooper |
| 4,430,372 | A | | 2/1984 | Knoke et al. |
| 4,436,788 | A | | 3/1984 | Cooper |
| 4,438,533 | A | | 3/1984 | Hefele |
| 4,446,274 | A | | 5/1984 | Okazaki et al. |
| 4,465,723 | A | | 8/1984 | Knoke et al. |
| 4,504,434 | A | | 3/1985 | Cooper |
| 4,510,274 | A | | 4/1985 | Okazaki et al. |
| 4,539,166 | A | | 9/1985 | Richartz et al. |
| 4,574,018 | A | | 3/1986 | Masuda et al. |
| 4,578,453 | A | | 3/1986 | Jackson, Jr. et al. |
| 4,582,658 | A | | 4/1986 | Reichmann et al. |
| 4,588,629 | A | | 5/1986 | Taylor |
| 4,599,262 | A | | 7/1986 | Schulte et al. |
| 4,610,904 | A | | 9/1986 | Mahn, Sr. et al. |
| 4,650,533 | A | | 3/1987 | Parker et al. |
| 4,652,478 | A | | 3/1987 | Maii |
| 4,668,323 | A | | 5/1987 | Lenards et al. |
| 4,670,089 | A | | 6/1987 | Hanson |
| 4,681,791 | A | | 7/1987 | Shibahashi et al. |
| 4,687,527 | A | | 8/1987 | Higashiguchi |
| 4,693,771 | A | | 9/1987 | Payet et al. |
| 4,741,791 | A | | 5/1988 | Howard et al. |
| 4,790,306 | A | | 12/1988 | Braun et al. |
| 4,793,884 | A | | 12/1988 | Horikiri |
| 4,797,320 | A | | 1/1989 | Kopp et al. |
| 4,810,321 | A | | 3/1989 | Wank et al. |
| 4,810,549 | A | | 3/1989 | Abrams et al. |
| 4,812,247 | A | | 3/1989 | Fahner et al. |
| 4,812,357 | A | | 3/1989 | O'Rell et al. |
| 4,834,502 | A | | 5/1989 | Bristol et al. |
| RE33,032 | E | | 8/1989 | Binsack et al. |
| 4,861,644 | A | | 8/1989 | Young et al. |
| 4,895,748 | A | | 1/1990 | Squires |
| 4,906,464 | A | | 3/1990 | Yamamoto et al. |
| 4,923,848 | A | | 5/1990 | Akada et al. |
| 4,931,125 | A | | 6/1990 | Volkmann et al. |
| 4,937,115 | A | | 6/1990 | Leatherman |
| 4,961,896 | A | * | 10/1990 | Constantino ..... 264/293 |
| 4,966,801 | A | | 10/1990 | Becker et al. |
| 4,972,015 | A | | 11/1990 | Carico et al. |
| 4,980,216 | A | | 12/1990 | Rompp |
| 4,981,750 | A | | 1/1991 | Murphy et al. |
| 4,985,296 | A | | 1/1991 | Mortimer, Jr. |
| 5,008,130 | A | | 4/1991 | Lenards |
| 5,009,943 | A | * | 4/1991 | Stahl ..... 428/40.6 |
| 5,009,950 | A | | 4/1991 | Wagner et al. |
| 5,021,289 | A | | 6/1991 | Light et al. |
| 5,026,591 | A | | 6/1991 | Henn et al. |
| 5,041,104 | A | | 8/1991 | Seal |
| 5,043,375 | A | | 8/1991 | Henning et al. |
| 5,047,103 | A | | 9/1991 | Abrams et al. |
| 5,053,179 | A | | 10/1991 | Masui et al. |
| 5,059,452 | A | | 10/1991 | Squires |
| 5,066,537 | A | | 11/1991 | O'Rell et al. |
| 5,077,116 | A | | 12/1991 | Lefkowitz |
| 5,104,723 | A | | 4/1992 | Freitag et al. |
| 5,108,530 | A | | 4/1992 | Niebling, Jr. et al. |
| 5,110,670 | A | | 5/1992 | Janocha et al. |
| 5,112,423 | A | | 5/1992 | Liebe, Jr. |
| 5,115,104 | A | | 5/1992 | Bunyan |
| 5,126,182 | A | | 6/1992 | Lumb et al. |
| 5,143,672 | A | | 9/1992 | Kuwahara |
| 5,144,334 | A | | 9/1992 | Suzuki et al. |
| 5,154,871 | A | | 10/1992 | Wagner et al. |
| 5,155,163 | A | | 10/1992 | Abeywardena et al. |
| 5,196,262 | A | | 3/1993 | Schwarz et al. |
| 5,198,277 | A | | 3/1993 | Hamilton et al. |
| 5,207,851 | A | | 5/1993 | Abrams |
| 5,217,563 | A | | 6/1993 | Niebling et al. |

5,217,781 A 6/1993 Kuipers
5,228,655 A 7/1993 Garcia et al.
5,238,737 A 8/1993 Burkhardt et al.
5,248,536 A 9/1993 Du Katz
5,274,039 A 12/1993 Sirinyan et al.
5,298,031 A 3/1994 Gabay et al.
5,302,223 A 4/1994 Hale
5,306,567 A 4/1994 Kuo et al.
5,312,576 A 5/1994 Swei et al.
5,326,391 A 7/1994 Anderson et al.
5,338,603 A 8/1994 Mahn et al.
5,342,892 A 8/1994 Vanderbilt et al.
5,346,746 A 9/1994 Abrams
5,347,927 A 9/1994 Berna et al.
5,348,699 A 9/1994 Meyer et al.
5,350,474 A 9/1994 Yamane
5,350,830 A 9/1994 Kuo et al.
5,352,507 A 10/1994 Bresson et al.
5,358,789 A 10/1994 Kuo et al.
5,382,628 A 1/1995 Stewart et al.
5,383,996 A 1/1995 Dressler
5,385,694 A 1/1995 Wu et al.
5,385,773 A 1/1995 Yau et al.
5,393,609 A 2/1995 Chang et al.
5,403,884 A 4/1995 Perlinski
5,411,783 A * 5/1995 Mahn, Jr. ..... 428/79
5,413,841 A * 5/1995 Mahn et al. ..... 428/195.1
5,431,501 A 7/1995 Hale et al.
5,442,036 A 8/1995 Beavers et al.
5,447,462 A 9/1995 Smith et al.
5,464,909 A 11/1995 Chang et al.
5,480,506 A 1/1996 Mahn, Sr. et al.
5,487,614 A 1/1996 Hale
5,488,907 A 2/1996 Xu et al.
5,489,359 A 2/1996 Yamane
5,508,084 A 4/1996 Reeves et al.
5,511,248 A 4/1996 Widdemer
5,520,988 A 5/1996 Kuwahara
5,522,317 A 6/1996 Hale et al.
5,529,650 A 6/1996 Bowers et al.
5,534,099 A 7/1996 Yamamoto
5,543,195 A 8/1996 Squires et al.
5,555,813 A 9/1996 Hale et al.
5,556,669 A 9/1996 Sasaki et al.
5,564,249 A 10/1996 Borys et al.
5,575,877 A 11/1996 Hale et al.
5,589,022 A 12/1996 Kuwahara
5,590,600 A 1/1997 Hale et al.
5,597,633 A 1/1997 Mecke et al.
5,597,637 A 1/1997 Abrams et al.
5,599,416 A 2/1997 Kuwahara
5,601,023 A 2/1997 Hale et al.
5,622,587 A 4/1997 Barthelman
5,640,180 A 6/1997 Hale et al.
5,642,141 A 6/1997 Hale et al.
5,644,988 A 7/1997 Xu et al.
5,654,395 A 8/1997 Jackson, Jr. et al.
5,658,630 A 8/1997 Shizukuda et al.
5,665,458 A * 9/1997 Mahn, Jr. ..... 428/202
5,677,037 A 10/1997 Kuwahara
5,681,420 A 10/1997 Yamane
5,685,223 A 11/1997 Vermuelen et al.
5,693,400 A 12/1997 Hamilton et al.
5,696,536 A 12/1997 Murphy
5,734,396 A 3/1998 Hale et al.
5,746,816 A 5/1998 Xu
5,756,180 A 5/1998 Squires et al.
5,762,379 A 6/1998 Salmon et al.
5,766,397 A 6/1998 Jones
5,771,796 A 6/1998 Morrison et al.
5,804,007 A 9/1998 Asano
5,820,968 A 10/1998 Kurani
5,830,263 A 11/1998 Hale et al.
5,837,347 A 11/1998 Marecki
5,851,617 A 12/1998 Keiser
5,858,156 A 1/1999 Abrams et al.
5,863,633 A 1/1999 Squires et al.
5,866,248 A 2/1999 Dressler
5,900,096 A 5/1999 Zemel
5,909,021 A 6/1999 Duffy
5,912,065 A 6/1999 Kukoff
5,914,176 A * 6/1999 Myers ..... 428/195.1
5,922,436 A 7/1999 Banfield et al.
5,942,311 A 8/1999 Scianna
5,981,009 A 11/1999 Iacono et al.
5,981,021 A 11/1999 McCulloch
5,997,995 A 12/1999 Scianna
6,010,764 A 1/2000 Abrams
6,025,068 A 2/2000 Pekala
6,083,332 A 7/2000 Abrams
6,102,686 A 8/2000 Eschenfelder
6,103,041 A 8/2000 Wagner et al.
6,105,502 A 8/2000 Wagner et al.
6,110,560 A 8/2000 Abrams
6,113,149 A 9/2000 Dukatz
6,114,023 A 9/2000 Schwarz et al.
6,146,485 A 11/2000 Iacono et al.
6,152,038 A 11/2000 Wagner et al.
6,170,881 B1 1/2001 Salmon et al.
6,171,678 B1 1/2001 Holeschovsky et al.
6,178,680 B1 1/2001 Sloot
6,202,549 B1 3/2001 Mitsam et al.
6,224,707 B1 5/2001 Lion
6,247,215 B1 6/2001 Van Alboom et al.
6,249,297 B1 6/2001 Lion
6,257,866 B1 7/2001 Fritz et al.
6,264,775 B1 7/2001 Holeschovsky et al.
6,265,332 B1 7/2001 Yoshida et al.
6,277,312 B1 8/2001 Hansen et al.
6,296,908 B1 10/2001 Reihs et al.
6,299,715 B1 10/2001 Langsdorf et al.
6,341,856 B1 1/2002 Thompson et al.
6,348,939 B1 2/2002 Xu et al.
6,350,504 B1 2/2002 Alboom et al.
6,361,855 B2 3/2002 Mahn, Jr. et al.
6,376,041 B1 4/2002 Morrison et al.
6,387,472 B1 5/2002 Reck et al.
6,402,313 B1 6/2002 Xu et al.
6,425,331 B1 7/2002 Xu et al.
6,428,877 B1 8/2002 Suss et al.
6,436,506 B1 8/2002 Pinter et al.
6,439,710 B1 8/2002 Hale et al.
6,447,629 B1 9/2002 Thompson et al.
6,450,098 B1 9/2002 Hale et al.
6,451,148 B1 9/2002 Jenner
6,481,015 B1 11/2002 Lanier
6,486,903 B1 11/2002 Wagner et al.
6,488,370 B2 12/2002 Hale et al.
6,489,038 B1 12/2002 Sperlich et al.
6,540,345 B1 4/2003 Wagner et al.
6,544,634 B1 4/2003 Abrams et al.
6,555,648 B1 4/2003 Hinds
6,569,538 B1 5/2003 Kaschel
6,577,657 B1 6/2003 Elschner et al.
6,630,216 B2 10/2003 Pophusen et al.
6,631,984 B2 10/2003 Thompson et al.
6,646,022 B2 11/2003 Okazaki et al.
6,648,926 B1 11/2003 Immediato
6,660,352 B2 12/2003 Hsu et al.
6,676,796 B2 1/2004 Pinter et al.
6,770,581 B1 8/2004 DeMott et al.
6,774,067 B2 8/2004 Demott et al.
6,783,184 B2 8/2004 DiBattista et al.
6,787,589 B2 9/2004 Weaver et al.
6,804,978 B2 10/2004 Kost
6,818,293 B1 11/2004 Keep et al.
6,836,915 B2 1/2005 Song et al.
6,841,240 B2 1/2005 Gorny et al.
6,875,395 B2 4/2005 Kisha et al.
6,913,714 B2 7/2005 Liu et al.
6,924,000 B2 8/2005 Tallmadge
6,929,771 B1 8/2005 Abrams
6,939,666 B2 9/2005 Matsumoto
6,972,305 B1 12/2005 Griessmann et al.
6,977,023 B2 12/2005 Abrams
7,021,549 B2 4/2006 O'Rell et al.
7,073,762 B2 7/2006 Pearson
7,135,518 B2 11/2006 Bandou et al.

| | | | | |
|---|---|---|---|---|
| 7,138,359 | B2 | 11/2006 | Washizuka | |
| 7,214,339 | B2 | 5/2007 | Tsunekawa et al. | |
| 7,229,680 | B1 | 6/2007 | Crompton | |
| 7,265,258 | B2 | 9/2007 | Hamilton et al. | |
| 7,344,769 | B1 | 3/2008 | Abrams | |
| 7,393,516 | B2 | 7/2008 | Seo et al. | |
| 7,410,932 | B2 * | 8/2008 | Figueroa | 503/227 |
| 7,461,444 | B2 | 12/2008 | Deaett et al. | |
| 8,012,893 | B1 | 9/2011 | Liebe | |
| 8,110,059 | B2 | 2/2012 | Kuwahara | |
| 2001/0008039 | A1 | 7/2001 | Alboom et al. | |
| 2001/0008672 | A1 | 7/2001 | Norvell et al. | |
| 2002/0009571 | A1 | 1/2002 | Abrams | |
| 2002/0098329 | A1 | 7/2002 | Abrams | |
| 2002/0197622 | A1 | 12/2002 | McDevitt et al. | |
| 2003/0129353 | A1 | 7/2003 | Abrams | |
| 2003/0152779 | A1 | 8/2003 | Kondo et al. | |
| 2003/0186019 | A1 | 10/2003 | Abrams | |
| 2003/0192109 | A1 | 10/2003 | Barthelemy | |
| 2003/0203152 | A1 | 10/2003 | Higgins et al. | |
| 2003/0207072 | A1 | 11/2003 | Abrams | |
| 2003/0211279 | A1 | 11/2003 | Abrams | |
| 2004/0010093 | A1 | 1/2004 | Wefringhaus et al. | |
| 2004/0033334 | A1 | 2/2004 | Merovitz | |
| 2004/0050482 | A1 | 3/2004 | Abrams | |
| 2004/0053001 | A1 | 3/2004 | Abrams | |
| 2004/0055692 | A1 | 3/2004 | Abrams | |
| 2004/0058120 | A1 | 3/2004 | Abrams | |
| 2004/0081791 | A1 | 4/2004 | Abrams | |
| 2004/0142176 | A1 | 7/2004 | Wang | |
| 2004/0170799 | A1 | 9/2004 | Carr et al. | |
| 2004/0180592 | A1 | 9/2004 | Ray | |
| 2004/0214493 | A1 | 10/2004 | Smith | |
| 2004/0238103 | A1 | 12/2004 | Cano | |
| 2005/0000622 | A1 | 1/2005 | Cano | |
| 2005/0081985 | A1 | 4/2005 | Abrams | |
| 2005/0124734 | A1 | 6/2005 | Hucks et al. | |
| 2005/0136211 | A1 | 6/2005 | McGovern et al. | |
| 2005/0158508 | A1 | 7/2005 | Abrams | |
| 2005/0158554 | A1 | 7/2005 | Wang et al. | |
| 2005/0159575 | A1 | 7/2005 | Rische et al. | |
| 2005/0188447 | A1 | 9/2005 | Gray | |
| 2005/0193461 | A1 | 9/2005 | Caillibotte et al. | |
| 2005/0196594 | A1 | 9/2005 | O'Rell et al. | |
| 2005/0223753 | A1 | 10/2005 | Nordstrom | |
| 2005/0260378 | A1 | 11/2005 | Bernabeu | |
| 2005/0266204 | A1 | 12/2005 | Abrams | |
| 2005/0268407 | A1 | 12/2005 | Abrams | |
| 2005/0279445 | A1 | 12/2005 | Shemanski et al. | |
| 2006/0010562 | A1 | 1/2006 | Bevier | |
| 2006/0026778 | A1 | 2/2006 | Lion | |
| 2006/0029767 | A1 | 2/2006 | Lion | |
| 2006/0080752 | A1 | 4/2006 | Darling et al. | |
| 2006/0142405 | A1 | 6/2006 | Kijima | |
| 2006/0150300 | A1 | 7/2006 | Hassan et al. | |
| 2006/0160943 | A1 | 7/2006 | Weir | |
| 2006/0162050 | A1 | 7/2006 | Kaufman et al. | |
| 2006/0183851 | A1 | 8/2006 | Liu et al. | |
| 2006/0234015 | A1 * | 10/2006 | Figueroa | 428/195.1 |
| 2006/0251852 | A1 | 11/2006 | Abrams | |
| 2006/0257618 | A1 | 11/2006 | Pascual Bernabeu | |
| 2007/0003761 | A1 | 1/2007 | Miyazono et al. | |
| 2007/0022510 | A1 | 2/2007 | Chapuis et al. | |
| 2007/0022548 | A1 | 2/2007 | Abrams | |
| 2007/0026189 | A1 | 2/2007 | Abrams | |
| 2007/0102093 | A1 | 5/2007 | Abrams | |
| 2007/0110949 | A1 | 5/2007 | Abrams | |
| 2007/0148397 | A1 | 6/2007 | Abrams | |
| 2007/0172609 | A1 | 7/2007 | Williams | |
| 2007/0181241 | A1 | 8/2007 | Kramer et al. | |
| 2007/0219073 | A1 | 9/2007 | Mannschedel | |
| 2007/0251636 | A1 | 11/2007 | Herbert | |
| 2007/0264462 | A1 | 11/2007 | Covelli et al. | |
| 2007/0289688 | A1 | 12/2007 | Abrams | |
| 2007/0289712 | A1 | 12/2007 | Higashiguchi et al. | |
| 2007/0298681 | A1 | 12/2007 | Liu | |
| 2008/0003394 | A1 | 1/2008 | Eke | |
| 2008/0003399 | A1 | 1/2008 | Abrams | |
| 2008/0006968 | A1 | 1/2008 | Abrams | |
| 2008/0050548 | A1 | 2/2008 | Abrams | |
| 2008/0095973 | A1 * | 4/2008 | Abrams | 428/90 |
| 2008/0102239 | A1 | 5/2008 | Abrams | |
| 2008/0111047 | A1 | 5/2008 | Abrams | |
| 2008/0113144 | A1 | 5/2008 | Abrams | |
| 2008/0118695 | A1 | 5/2008 | Jarvis et al. | |
| 2008/0124503 | A1 * | 5/2008 | Abrams | 428/34.1 |
| 2008/0145585 | A1 | 6/2008 | Abrams | |
| 2008/0150186 | A1 | 6/2008 | Abrams | |
| 2008/0153388 | A1 | 6/2008 | Liu | |
| 2008/0177415 | A1 | 7/2008 | Rahimi | |
| 2008/0187706 | A1 | 8/2008 | Lion et al. | |
| 2008/0250668 | A1 | 10/2008 | Marvin et al. | |
| 2008/0295216 | A1 | 12/2008 | Nordstrom et al. | |
| 2008/0299397 | A1 | 12/2008 | Kenens et al. | |
| 2009/0022929 | A1 | 1/2009 | Kramer et al. | |
| 2009/0025123 | A1 * | 1/2009 | Weedlun et al. | 2/244 |
| 2009/0124150 | A1 | 5/2009 | Covelli et al. | |
| 2009/0133181 | A1 | 5/2009 | Nordstrom et al. | |
| 2009/0181599 | A1 | 7/2009 | Farmer et al. | |
| 2009/0197091 | A1 | 8/2009 | Kirk, II et al. | |
| 2009/0239025 | A1 * | 9/2009 | Abrams | 428/90 |
| 2009/0259169 | A1 | 10/2009 | Loori et al. | |
| 2009/0280290 | A1 * | 11/2009 | Weedlun | 428/102 |
| 2009/0286039 | A1 | 11/2009 | Weedlun et al. | |
| 2009/0320174 | A1 | 12/2009 | Turner | |
| 2010/0043114 | A1 | 2/2010 | Caillibotte et al. | |
| 2010/0051132 | A1 | 3/2010 | Glenn | |
| 2010/0055358 | A1 | 3/2010 | Weaver et al. | |
| 2010/0068964 | A1 | 3/2010 | Baychar | |
| 2010/0092720 | A1 | 4/2010 | Abrams | |
| 2010/0095550 | A1 | 4/2010 | Sokolowski et al. | |
| 2010/0119760 | A1 | 5/2010 | Kirk, II et al. | |
| 2010/0130085 | A1 | 5/2010 | Yu et al. | |
| 2010/0143669 | A1 * | 6/2010 | Abrams | 428/196 |
| 2010/0178445 | A1 | 7/2010 | Shen et al. | |
| 2010/0233410 | A1 | 9/2010 | Abrams | |
| 2010/0276060 | A1 | 11/2010 | Abrams | |
| 2010/0316832 | A1 | 12/2010 | Abrams | |
| 2011/0008618 | A1 | 1/2011 | Weedlun | |
| 2011/0052859 | A1 | 3/2011 | Abrams | |
| 2011/0223373 | A1 | 9/2011 | Abrams | |
| 2012/0015156 | A1 | 1/2012 | Abrams | |
| 2012/0028003 | A1 | 2/2012 | Abrams | |

FOREIGN PATENT DOCUMENTS

| | | |
|---|---|---|
| CA | 757595 | 4/1967 |
| CA | 2010076 | 8/1990 |
| CA | 1306411 | 8/1992 |
| CA | 2064300 | 9/1992 |
| DE | 19707381 | 8/1998 |
| DE | 19734316 | 2/1999 |
| EP | 0122656 | 10/1984 |
| EP | 0210304 | 2/1987 |
| EP | 0280296 | 8/1988 |
| EP | 0351079 | 1/1990 |
| EP | 0506601 | 9/1992 |
| EP | 0685014 | 12/1995 |
| EP | 0913271 | 10/1998 |
| EP | 0989227 | 3/2000 |
| EP | 1072712 | 1/2001 |
| EP | 1557206 | 7/2005 |
| EP | 1598463 | 11/2005 |
| FR | 1480860 | 5/1967 |
| FR | 2210149 | 7/1974 |
| FR | 2442721 | 8/1980 |
| FR | 2543984 | 10/1984 |
| FR | 2659094 | 9/1991 |
| FR | 2784619 | 4/2000 |
| FR | 2846202 | 4/2004 |
| FR | 2881149 | 7/2006 |
| GB | 1171296 | 11/1969 |
| GB | 1190883 | 5/1970 |
| GB | 1447049 | 8/1976 |
| GB | 1466271 | 3/1977 |
| GB | 2065031 | 6/1981 |
| GB | 2101932 | 1/1983 |
| GB | 2126951 | 4/1984 |
| GB | 2214869 | 9/1989 |

| | | | |
|---|---|---|---|
| GB | 2227715 | | 8/1990 |
| GB | 0506601 | | 9/1992 |
| IE | 55104 | | 10/1984 |
| JP | 71007184 | | 6/1965 |
| JP | 52-155270 | | 12/1977 |
| JP | 54-163934 | | 12/1979 |
| JP | 55079143 | | 6/1980 |
| JP | 55-147171 | | 11/1980 |
| JP | 56058824 | | 5/1981 |
| JP | 56107080 | | 8/1981 |
| JP | 56108565 | | 8/1981 |
| JP | 56141877 | | 11/1981 |
| JP | 58062027 | | 4/1983 |
| JP | 59106944 | | 6/1984 |
| JP | 59115885 | | 7/1984 |
| JP | 60-171138 | | 9/1985 |
| JP | 60-236738 | | 11/1985 |
| JP | S61-146368 | | 7/1986 |
| JP | 62-033576 | | 2/1987 |
| JP | 62-144911 | | 6/1987 |
| JP | 63118544 | | 5/1988 |
| JP | 64-014021 | | 1/1989 |
| JP | S64-068582 | | 3/1989 |
| JP | 01192538 | | 8/1989 |
| JP | 01-266284 | | 10/1989 |
| JP | 01-310947 | | 12/1989 |
| JP | 02048076 | | 2/1990 |
| JP | 2-25667 | | 6/1990 |
| JP | AP 491623 | | 7/1991 |
| JP | 04-126221 | | 4/1992 |
| JP | 04-169297 | | 6/1992 |
| JP | 5-201196 | | 8/1993 |
| JP | 05-255021 | | 10/1993 |
| JP | 06-171048 | | 6/1994 |
| JP | 08-267625 | | 10/1996 |
| JP | 10059790 | | 3/1998 |
| JP | 10-202691 | | 8/1998 |
| JP | 11-042749 | | 2/1999 |
| JP | 11256484 | | 9/1999 |
| JP | 11277662 | | 10/1999 |
| JP | 11348159 | | 12/1999 |
| JP | 2000084977 | | 3/2000 |
| JP | 2000-094563 | | 4/2000 |
| JP | 2000-208564 | | 7/2000 |
| JP | 3076851 | | 8/2000 |
| JP | 2000263673 | | 9/2000 |
| JP | 2001-226885 | | 8/2001 |
| JP | 2001-270019 | | 10/2001 |
| JP | 2001324928 | | 11/2001 |
| JP | 2004100050 | | 4/2004 |
| KR | 2003063833 | | 7/2003 |
| KR | 2008097063 | A * | 11/2008 |
| SE | 329767 | | 10/1970 |
| WO | WO 79/01146 | | 12/1979 |
| WO | WO 89/01829 | | 3/1989 |
| WO | WO 90/09289 | | 8/1990 |
| WO | WO 92/04502 | | 3/1992 |
| WO | WO 93/12283 | | 6/1993 |
| WO | WO 94/19530 | | 9/1994 |
| WO | WO 97/34507 | | 9/1997 |
| WO | WO 02/07959 | | 1/2002 |
| WO | WO 02/09925 | | 2/2002 |
| WO | WO 02/058854 | | 8/2002 |
| WO | WO 03/031083 | | 4/2003 |
| WO | WO 2004/005023 | | 1/2004 |
| WO | WO 2004/005413 | | 1/2004 |
| WO | WO 2004/005600 | | 1/2004 |
| WO | WO 2005/035235 | | 4/2005 |
| WO | WO 2005/118948 | | 12/2005 |

OTHER PUBLICATIONS

"PolyOne—OnFlexTM-S EL Economy Grades (Low Density)", PolyOne® Corporation 2007, pp. 1-2.

"PolyOne—OnFlexTM-S FG Food Contact Grades", PolyOne® Corporation 2007, pp. 1-2.

"PolyOne—OnFlexTM-S KE Grades For 2K Moulding on Engineered Thermoplastics", PolyOne® Corporation 2007, pp. 1-2.

"PolyOne—OnFlexTM-S Thermoplastic Elastomer Compounds", PolyOne® Corporation 2007, pp. 1-6.

"PolyOne—Synprene RT-3750", PolyOne® Corporation Feb. 9, 2010, 1 page.

U.S. Appl. No. 12/624,254, filed Nov. 23, 2009, Abrams.

U.S. Appl. No. 12/636,421, filed Dec. 11, 2009, Abrams.

U.S. Appl. No. 12/612,524, filed Nov. 4, 2009, Abrams.

U.S. Appl. No. 12/706,622, filed Feb. 16, 2010, Abrams.

"PolyOne—OnFlex™—S Styrenic Thermoplastic Elastomers", printed Feb. 9, 2010, 2 pages.

"PolyOne—Synprene RT-3790", PolyOne® Corporation Feb. 9, 2010, 1 page.

"PolyOne—Synprene RT-3850MS", PolyOne® Corporation Feb. 9, 2010, 1 page.

"PolyOne—Synprene RT-3870M", PolyOne® Corporation Feb. 9, 2010, 1 page.

"PolyOne—Synprene RT-3770", PolyOne® Corporation Feb. 9, 2010, 1 page.

"Versaflex® OM Series Material Review", TPE Tips, Issue 5, GLS Corporation Rev. Jan. 12, 2007, 2 pages.

"Versaflex® OM 3060-1—Technical Data Sheet", GLS Corporation, available at http://glscorporation.com/gls2/print.jsp?productID=182, Feb. 9, 2010, 2 pages.

U.S. Appl. No. 29/058,551, filed Aug. 19, 1996, Abrams.

U.S. Appl. No. 09/548,839, filed Apr. 13, 2000, Abrams.

U.S. Appl. No. 11/972,440, filed Jan. 10, 2008, Abrams.

"Eckart—Excellence in effect pigments"; Eckart GmBH & Co. KG; available at http://www.eckartamerica.com/page.asp?NavigationID=15&MainNavigationID=3&PageID=16; printed Aug. 21, 2006; 2 pages.

"Eckart Inks"; Eckart GmBH & Co. KG; available at http://www.deltatecnic.com/eckinken.htm; printed Aug. 21, 2006; 2 pages.

"Metallic pigment dispersions, pellets and powders for Inks"; Eckart, undated, 28 pages.

"Disperse Dyes for Textiles," Organic Dyestuffs Corporation (2003), available at http://www.organicdye.com/textiledisperseindex.asp, 4 pages.

"Fabric Processing Guidelines and Expected Product Attributes," Wellman, Inc., The Fibers Division (Jul. 25, 2001), 8 pages.

Bostik USA; "Automotive & Industrial Division: Web & Powder Adhesives" (2002), available at http://www.bostik.com/oem/web_adhesives.html, 2 pages.

Bostik USA; "Industrial Adhesives" (2001), 3 pages.

Bostik USA; Web & Powder Adhesives; 2000; 2 pgs.

Bostik, "Web Adhesives", available at http://ww.bostik-us.com/products/index.asp?fa+subCategories&divisionId=4&categoryId=11&subCategoryID=22, printed Jun. 18, 2007, pp. 1-2.

Cohn, Larry, "When is a 'Dye Sublimation' Printer NOT a 'Dye Sublimation' Printer?" Fun Faces Foto Gifts (Oct. 2001), available at http://www.dyesub.org/articles/dyesubprinter.htm, 7 pages.

Ford, Don, "Inkjet Transfer Printing (not dye sublimation)," Fords Screen Printing (Oct. 2001), available at http://www.dyesub.org/articles/inkjet.shtm, 2 pages.

GE Structured Products, "Lexan® In-Mold Films: A Guide for Designing, Forming and Molding with Screenprinted Lexan® Films" (Jan. 1999), pp. 1-20.

Griffin, Patrick J., "Film Insert Molding," SGIA Journal, First Quarter 2001, pp. 31-36.

Juracek "Soft Surfaces", W.W. Norton & Company, Inc., 2000, 3 cover pages and pp. 310-323.

Krichevskii, G.E., "Textile Materials Made from Polyester Fibres—a Most Difficult Material to Color," Fibre Chemistry, vol. 33, No. 5 (Sep. 2001), pp. 364-367(4).

Lambert et al., "Color and Fiber", Schiffer Publishing Ltd., 1986, Cover, p. iv, p. 90-135, 242-247.

Sawgrass Technologies, Inc. Press Releases, available at http://www.sawgrassink.com/pressreleases/pressreleasearchives.htm, printed Jan. 22, 2004, 18 pages.

Saxon Screens—Products, www.saxon-screens.de/airmboss.html, 5 pages (Nov. 22, 2004).

Sean O'Leary, "Standard Transfer vs. Dye Sublimation: Requirements and Conditions for the Two Processes," The Big Picture Magazine, available at http://www.signweb.com/digital/tips/digitaltip7.html, 2 pages, Nov. 8, 2005.
Studt et al.; "Versatality on a roll: Thermoplastic adhesive films"; Collano; Oct. 2002; 8 pages.
Mock "Basotect®: a specialty foam in the sky and on earth", BASF Group: Trade Press Conference K 2004, Jun. 22, 2004, Ludwigshafen, Germany, pp. 1-2.
"Polymers", Chemistry, Unit 16, date unknonwn, pp. 313-325.
"Compression Moldable Thermoset Foam", BASF Corp., date unknown, 1 page.
Soller "Weave Definitions", Soller Composites, Copyright 2004, pp. 1-2.
"Basotect Product Data Sheet", Sound Control Servieces, date unknown, pp. 1-2.
"Basotect® Soundproofing Thermal insulation technology", BASF Plastics, date unknown, pp. 1-16.
MOCK "News Release", Trade press conferene K 2004, Jun. 22-23, 2004, Ludwigshafen, Germany, 7 pages.
Declaration of L. Brown Abrams Under 37 CFR § 1.98 for U.S. Appl. No. 09/735,721 dated Jan. 16, 2004, 2 pages.
Declaration of L. Brown Abrams under 37 CFR § 1.98 for U.S. Appl. No. 09/621,830 dated Jan. 7, 2003, 2 pages.
Declaration of L. Brown Abrams under 37 CFR § 1.98 for U.S. Appl. No. 10/394,357 dated Jan. 16, 2004, 4 pages with Appendix A-I.
Declaration of L. Brown Abrams under 37 CFR 1.132 for U.S. Appl. No. 09/735,721dated Jan. 7, 2003.
Declaration of L. Brown Abrams Under 37 CFR 1.98 Executed Nov. 22, 2003 for U.S. Appl. No. 10/614,340, filed Jul. 3, 2003.
Declaration of L. Brown Abrams under 37 CFR § 1.98 for U.S. Appl. No. 09/621,830 dated Jan. 16, 2004, 2 pages.
Declaration of L. Brown Abrams under 37 CFR § 1.98 for U.S. Appl. No. 10/394,357 dated Jan. 3, 2007, 4 pages with Appendix A-I.
Second Supplemental Declaration of L. Brown Abrams under 37 CFR §1.132 for U.S. Appl. No. 09/548,839 executed Jan. 7, 2003.
Supplemental Declaration of L. Brown Abrams under 37 CFR § 1.132 for U.S. Appl. No. 09/548,839 executed Oct. 23, 2002.
Declaration of Louis Brown Abrams under 37 CFR § 1.98, for U.S. Appl. No. 11/460,493, signed Jan. 11, 2008, 5 pages.
International Search Report for International (PCT) Patent Application No. PCT/US08/54009, mailed Jun. 25, 2008.
Written Opinion for International (PCT) Patent Application No. PCT/US08/54009, mailed Jun. 25, 2008.
Oelsner, A Handbook of Weaves, The MacMillan Company, New York, NY, translated and revised by Samuel S. Dale, 1915, 418 pages.
Robinson et al., Woven Cloth Construction, The Textile Institute, Manchester, 1973, pp. 1-178.
Sondhelm, "Technical fabric structures—1. Woven fabrics," Chapter 4 of Handbook of Technical Textiles, CRC Press/Woodhead Pub, Boca Raton, FL, 2000, pp. 62-94.
Watson, Advanced Textile Design, Longmans, Green & Co, London, 1913, 484 pages.
Watson, Textile Design and Colour: Elementary Weaves and Figured Fabrics, Longmans, Green & Co, London, 1912, 370 pages.
"A Rug Fit for a Mouse," Time Magazine (Sep. 28, 1998) p. 96.
"Aeroshoes the microporous membrane for absorption and desorption," AeroShoes; available at http://www.aeroshoes.com/flashon/product/default.htm; 1 page; undated.
"AK Coatings—Applications" page; AK Coatings; before Nov. 1, 2002; www.akcoatings.com/applications/default.asp.
"AK Coatings—Growing Demand" page; AK Coatings; before Nov. 1, 2002; www.akcoatings.com/growing_demand/default.asp.
"AK Coatings—Home" page; AK Coatings; before Nov. 1, 2002; www.akcoatings.com.
"AK Coatings—How It Works" page; AK Coatings; before Nov. 1, 2002; www.akcoatings.com/how_it_works/default.asp.
"AK Coatings—Specify and Purchase" page; AK Coatings; before Nov. 1, 2002; www.akcoatings.com/specifiy_purchase/default.asp.
"Bemis—Specialty Films," available at http://www.benisworldwide.com/products/films.html; 2004; 2 pages.
"Celgard Announces New Products and New Customer," May 2, 2005; 1 page.
"Characteristics of Commonly Used Elastomers" avaliable at http://www.deerfieldurethane.com/Deerfield-Urethane_Brochure.pdf, date unknown, 4 pages.
"Corterra Polymers," (printed Mar. 8, 2004) http://www.swicofil.com/ptt.html, 4 pages.
"Door Panels Collano overcomes strain forces," Collano AG, Switzerland, Oct. 2004; 1 page.
"E/Barrier Material Safety Data Sheet (MSDS)," Midsun Group, Apr. 4, 2006, pp. 1-5.
"Engineering of Wool Carpet Yarns: Yarn Bonding Technology," Wools of New Zealand (2002), available at http://www.canesis.com/Documents/Yarn_bonding_technology.pdf, pp. 1-13.
"Flockin' to Precision," Images Magazine; Feb. 1992, 1 page.
"Hettinga: Plastics Technology for the Future, Available Today!" website (circa 2000), 4 pages.
"Made of makrolon High-tech plastic from Bayer" General Purpose Product Data, Sheffield Plastics Inc., 2003, 2 pages.
"Magic Carpet" Wired Magazine (Nov. 1998), p. 68.
"Makrolon GP Solid polycarbonate sheet," Product Data Sheet, Oct. 2004, 2 pages.
"Makrolon GP Solid polycarbonate sheets," General Purpose Product Data Sheet, Laserlite Australia, date unknown, 2 pages.
"Material Safety Data Sheet," Nationwide Plastics, Inc., Jan. 1, 2007, pp. 1-6.
"Microthin.com Mouse Ads," available at http://www.microthin.com/index_flash.htm; undated, 1 page.
"Neoprene polychloroprene Technical Information," Rev. 5, Oct. 2003, pp. 1-16.
"Opposites Attract," Collano AG, Switzerland, Aug. 2004; 1 page.
"Product Information" Celgard Inc.; available at http://www.celgard.com/products/product-information.cfm; 1 page; undated.
"RMIUG Meeting Minutes—Colorado in the Information Age," Jan. 14, 1997; 1 page.
"Rugs for Rodents," Newsweek (Nov. 9, 1998), p. 8.
"Schaetti Fix 6005" Technical Data Sheet, Schaetti Fix, Jan. 1, 2006, 1 page.
"Schaetti Fix 6012" Technical Data Sheet, Schaetti Fix, Jan. 1, 2006, 1 page.
"Schaetti Fix 6040" Technical Data Sheet, Schaetti Fix, Jan. 3, 2006, 1 page.
"Schaetti Fix Cross Linking Test Product," Dynamic Coating Technology; Sep. 18, 2006; 4 pages.
"Surfaces: Clean Home Dream Home," AK Coatings; 2002; vol. 1, Issue 1.
"The largest range of plastic powder adhesives," Dynamic Coating Technology Schaetti Fix, date unknown, 8 pages.
"The largest range of thermoplastic powders," Dynamic Coating Technology Schaetti Fix, date unknown, 8 pages.
"Vestamelt," Degussa AG, date unknown, pp. 1-4.
Advertisement,"Clarense" at www.bemisworldwide.com (undated), 2 pages.
Agion Technologies, LLC., The Most Advanced Antimicrobial Silver Delivery System; (date unknown).
AK Steel Press Release "AK Steel's AgION™ Antimicrobial-Coated Steels Named One of the "Best of What's New" by Popular Science Magazine Bacteria Resistant Steels Win Distinguished Award in Home Technology Category," Dec. 1, 2001, 2 pages.
Artisyn Synthetic Paper 165, Printability Product Specification Sheet, Mar. 1999, 2 pages.
Artisyn Synthetic Paper 165, Printability Product Specification Sheet, Mar. 2001, 2 pages.
Artisyn Synthetic Paper 165, Printability Product Specification Sheet, May 1997, 1 page.
Artisyn Synthetic Paper Characteristics & Benefits, http://www.artisynpaper.com/index.cfm?fuseaction=Artisyn.Characteristics, printed Aug. 15, 2005, 2 pages.
Artisyn Synthetic Paper Handling & Storage, http://www.artisynpaper.com/index.cfm?fuseaction=Artisyn.Handling, printed Aug. 15, 2005, 2 pages.
Artisyn Synthetic Paper Printing Compatibility, http://www.artisynpaper.com/index.cfm?fuseaction=Artisyn.Printing, printed Aug. 15, 2005, 2 pages.

Artisyn Synthetic Paper Product Line, http://www.artisynpaper.com/index.cfm?fuseaction=Artisyn.Products, printed Aug. 15, 2005, 1 page.
Artisyn Synthetic Paper Product Overview, http://www.artisynpaper.com/index.cfm?fuseaction=Artisyn.Overview, printed Aug. 15, 2005, 2 page.
Artisyn® Synthetic Paper—Applications Commercial Printing, http://www.artisynpaper.com/index.cfm? fuseaction=Applications.CommercialPrinting, printed Aug. 15, 2005, 2 pages.
Artisyn® Synthetic Paper—Applications In-Mold Graphics, http://www.artisynpaper.com/index.cfm? fuseaction=Applications.InMoldGraphics, printed Aug. 15, 2005, 1 page.
Artisyn® Synthetic Paper—Applications Laminated Cards, http://www.artisynpaper.com/index.cfm? fuseaction=Applications.LaminatedCards, printed Aug. 15, 2005, 2 page.
Artisyn® Synthetic Paper—Applications Pressure Sensitive, http://www.artisynpaper.com/index.cfm? fuseaction=Applications.PressureSensitive, printed Aug. 15, 2005, 2 page.
Artisyn® Synthetic Paper—Applications Tags & Labels, http://www.artisynpaper.com/index.cfm? fuseaction=Applications.TagsLabels, printed Aug. 15, 2005, 2 pages.
Artisyn® Synthetic Paper—Typical Properties, http://www.artisynpaper.com/index.cfm?fuseaction=Properties.Typical, printed Aug. 15, 2005, 2 pages.
Artpads; Catalog; Jan. 27, 1999, available at http://www.accelerated.com/artpads/default.htm, 2 pages.
Bayer Films Americas, "Makrofol® DPF 5072 Polycarbonate Film Development Product," Feb. 2004, 2 pages.
Bayer Films Americas, "New Product Release—Unique Polycarbonate-Based Film for Bright Metallic Look Applications," Jul. 26, 2004, 1 page.
Bayer Films Americas, Makrofol® and Bayfol® advertising circular, 2004, 12 pages.
Bayer Plastics Division Press Release, Wheel Covers, Center Caps Become Revolving Art Forms with New Film Insert Molding Technology, Jun. 19, 2000; 4 pages.
Bemis; Sewfree; Adhesive Film for Seamless Apparel Construction; 2002; 1 page.
Bicomponent Fibers, available at http://web.utk.edu/~mse/pages/Textiles/Bicomponent%20fibers.htm, Updated Apr. 2004, 8 pages.
Bostik, "Technical Data Sheet PE103 Web Adhesives," revised Feb. 7, 2006, 5 pages.
Brown Abrams, "Flocking a Touch of Velour" ScreenPrinting (Apr. 1987).
Brown Abrams, "Part II: Flocking" ScreenPrinting (Jun. 1987).
Casa Nostra Designs; New York or the Big Apple; 1997, available at http://apropa.se/newyork.html, 1 page.
Cellusuede Products, Inc, "About Flock," Available at http://www.cellusuede.com/navabout.html, KMK Media Group, copyright 2000, 1 pages.
Cellusuede Products, Inc, "FAQ's," Available at http://www.cellusuede.com/faq.html, KMK Media Group, copyright 2000, 2 pages.
Cellusuede Products, Inc, "Fiber Types," Available at http://www.cellusuede.com/about/types.html, KMK Media Group, copyright 2000, 4 pages.
Cellusuede Products, Inc, "Glossary of Terms," Available at http://www.cellusuede.com/glossary/index.html, KMK Media Group, copyright 2000, 2 pages.
Cellusuede Products, Inc, "Uses for Flock, Home Furnishings," Available at http://www.cellusuede.com/home.html, KMK Media Group, copyright 2000, 2 pages.
Changpad Trading Inc.; Heat-Trans Pad; Jan. 27, 1999, available at http://www.changpad.com.tw/heat-trans.htm, 1 page.
Defosse; "Systems Approach Gives Blow Molders Big Edge," 2000.
Derrick, Cherie, "Sublimation, what is it?" Encompass Technologies (Oct. 2000), available at http://www.dyesub.org/articles/dyesubwhatisit.htm, 3 pages.
DuPont Thermx PCT Product and Properties Guide brochure dated Aug. 2003.
Eastman News Archive, DuPont Engineering Polymers Acquires High Performance Plastics Business from Eastman, printed Jul. 3, 2003, 2 pages.
Eastman PCT Polyester; New Resins New Services. . (undated) 5 pages.
Everglide; Everglide Mousing Surface & trade; Jan. 27, 1999, available at http://www.everglide.com/mousing_surface.htm, 1 page.
Excerpts from Obsolete Type 200 Series Brochure, undated, 3 pages.
Fake Fur Computer Accessories; Products; Jan. 27, 1999, available at http://workwares.com.au/products.htm, 3 pages.
Feature Story; Spandex can now be made from Thermoplastic Polyurethane using a new breakthrough flexible Process; Aug. 19, 2002.
Fiber Innovation Technology: Bicomponent Fibers, found at http://www.fitfibers.com/bicomponent_fibers.htm, undated (3 pages).
James B. Smith; "Buying New Carpet," Internet printout revised May 11, 2006, from http://www.carpetinspector.com/buying_new_carpet.htm; 6 pages, printed on Aug. 1, 2006.
JC Penney Catalog, Fall & Winter, accent rugs, A-B, p. 1032, in 2000 design library (1991).
Kelly, "New pads for computer mice now cutting a different rug," USA Today (Oct. 26, 1998).
Landwehr, Rebecca, "When is a mouse pad really a rug?" The Denver Business Journal (Nov. 1998), at http://denverbizjournalscom/denver/stories/1998/11/30/story3html.
Lextra® MouseRug®; "About the Product" (Jan. 27, 1999), http://www.mouserug.com/mouserug/aboutmouserugs.html, 2 pages.
Lextra® MouseRug®; "Dimensions" (Jan. 27, 1999), http://www.mouserug.com/mouserug/dimensions.html, 1 page.
Lextra® MouseRug®; "MouseRug Components" (Jan. 27, 1999), http://www.mouserug.com/mouserug/mousecomp.html, 1 page.
Lou Reade Reports "Surface Attention" European Plastics News (May 2003), p. 26.
Mark Matsco, Patrick Griffin, Film Insert Molding Technology, 1997.
Mouse Escalator; The only resolution to all your PC mouse problems; Jan. 27, 1999, 3 pages.
Orlych, "Silicone-Adhesive Interactions," ASI Adhesives & Sealants Industry; May 2004; 9 pages.
Peterson, Jeff, "New Innovations in 3D Curved Parts Decorating," Plastics Decorating (Oct.-Nov. 2001), available at http://www.petersonpublications.com/plasticsdecorating/articlesdisplay.asp?ID=17, 3 pages.
PPG Industries, Inc., "Chemical Compatibility of Teslin® Sheet," http://www.ppg.com/chm_teslin/whatsteslin/chem.htm, printed Jul. 27, 2005, 3 page.
PPG Industries, Inc., "Finishing Techniques for Teslin® Sheet," http://www.ppg.com/chm_teslin/whatsteslin/fin.htm, printed Jul. 27, 2005, 5 pages.
PPG Industries, Inc. "General Characteristics," http://www.ppg.com/chm_teslin/whatsteslin/gen.htm, printed Jul. 27, 2005, 2 page.
PPG Industries, Inc., "Grades of Teslin® Sheet," http://www.ppg.com/chm_teslin/whatsteslin/grades.htm, printed Jul. 27, 2005, 2 pages.
PPG Industries, Inc., "Handling & Storage," http://www.ppg.com/chm_teslin/whatsteslin/hand.htm, printed Jul. 27, 2005, 2 page.
PPG Industries, Inc., "Laminated Card Production," http://www.ppg.com/chm_teslin/whatsteslin/lam.htm, printed Jul. 27, 2005, 2 pages.
PPG Industries, Inc., "Printing on Teslin® Sheet," http://www.ppg.com/chm_teslin/whatsteslin/print.htm, printed Jul. 27, 2005, 2 page.
PPG Industries, Inc., "Properties of Teslin®," http://www.ppg.com/chm_teslin/whatsteslin/properties.htm, printed Jul. 27, 2005, 2 page.
PPG Industries, Inc., "Teslin® Product Printing Technology Compatibility," 2000, 1 page.
PPG Industries, Inc., "Teslin® Sheet and the Environment," http://www.ppg.com/chm_teslin/whatsteslin/environ.htm, printed Jul. 27, 2005, 2 pages.
PPG Industries, Inc., "Teslin® Synthetic Printing Sheet Technical Manual," 2000, 32 pages.
PPG Industries, Inc. "Weights and Sizes of Teslin® Sheet," http://www.ppg.com/chm_teslin/whatsteslin/weights.htm, printed Jul. 27, 2005, 2 pages.
PPG Industries, Inc. "What is Teslin® Sheet?," http://www.ppg.com/chm_teslin/whatsteslin/whatis.htm, printed Jul. 27, 2005, 2 pages.

Progressive Plastics, Inc.; Stretch Blow Guide; "Polymers," 12 page information sheet.
Progressive Plastics; "PET Information Guide—PET=Polyethylene Terephthalate," Internet printout from http://www.welshproducts.com/sub/sub_inst.htm; 4 pages, printed Aug. 1, 2006.
Protect-All Print Media, Inc., "Technical Information Artisyn® Synthetic Paper—Universal Grade," 5 pages (undated).
Sears Catalog, Spring/Summer, bath carpets, (B), fringed oblong, pp. 1290-1291, oriental design rugs, A-B, p. 1146, in 2000 design library (1978).
Shaner, Ken, "Advanced Molding Processes: Low Pressure Molding/Low-High Pressure Molding for Interior Trim," Automotive & Transportation Interior Expo Conference 1997, Session 9, p. 1.
Snyder, Merle R., "Fabric Molding Shows Promise in Automotive: Machine Makers Offer Innovative Systems That Boost Productivity and Facilitate Recyclability," Modern Plastics (Oct. 1999), available at http://www.modplas.com/new/month_1099/ms10.htm.
Sonics & Materials, Inc., "Chart II Compatability of Thermoplastics" (undated), 1 page.
Stahls', New Product Bulletin; 7 pages.
Takatori, Hiroyuki, "Dieprest In-mold Laminate Technology," Automotive & Transportation Interiors Expo Conference 1999, Session 12, pp. 1-4.
The Original PentaPad®; The Original PentaPad Specs; Jan. 27, 1999, available at http://penta-pad.com/specs.html, 2 pages.
Website entitled "Frequently Asked Questions (FAQ's)," A1 Custom Mousepad Imaging Inc. (2003), available at http://www.a1imaging.com/faqs.html, 2 pages.
Wikipedia, the free encyclopedia; "PET film (biaxially oriented)," Internet printout from http://en.wikipedia.org/wiki/PET_film_(biaxially_oriented); 3 pages, printed on Aug. 1, 2006.
"EB3304 Data Sheet." Bemis, Dec. 11, 2007, 1 page.
"Knitted fabric technology," Mini Knitting Stuff, printed Apr. 22, 2011 from http://www.miniknittingstuff.com/, 13 pages.
Knitting, Warp Knitting, List of Knitting Stitches, Cable Knitting, Casting on (knitting) and Cast off, printed from Wikipedia, Apr. 8, 2011, 32 pages.
"Library of Knitting Stitches—Knitting Stich Patterns." Barbar Breiter's Knitting on the Net, printed Mar. 23, 2011 from http://www.knittingonthenet.com/stitches.htm, 3 pages.
"Types of Knitting Machines: Warp Knitting, Weft Knitting, Intarsia, Double Knitting, Flat Knitting, Circular Knitting." textilesindepth, printed Apr. 6, 2011 from http://www.textilesindepth.com/index.php?page=types-knitting-machines.
International Preliminary Report on Patentability for International (PCT) Patent Application No. PCT/US08/54009, mailed Aug. 27, 2009.
U.S. Appl. No. 13/624,745, filed Sep. 21, 2012, Abrams.
U.S. Appl. No. 13/625,797, filed Sep. 24, 2012, Abrams.
U.S. Appl. No. 13/646,381, filed Oct. 5, 2012, Abrams.
"FiberLok Firsts!!!", Fort Collins, CO, USA, Mar. 2008, pp. 1-3.
"Jaquard loom", available at http://en.wikipedia.org/w/index.php?title=Jacquard_loom&printable=yes, printed Mar. 3, 2008, pp. 1-2.
"Jaquard Weaving—Techniques & Processes" available at http://craftvivaltrust.org/AHTML/CT-Jacquard.htm, printed Mar. 3, 2008, pp. 1-6.
"Jaquard weaving" available at http://en.wikipedia.org/w/index.php?title=Jacquard_weaving&printable=yes, printed Mar. 3, 2008, pp. 1-2.
"The TC-1 Loom From Tronud Engineering as in Norway", available at http://www.artsstudio.org/jacquardprnt.htm, dated Jul. 1, 1006, pp. 1-13.
Bright, Larry. "Trouble Shooting Continuous Thermosol Dyeing of Polyester Fiber and Blends". American Dyestuff Reporter, Aug. 1996, pp. 60-61.

* cited by examiner

SUBLIMATION DYE PRINTED TEXTILE

CROSS REFERENCE TO RELATED APPLICATION

The present application claims the benefits of U.S. Provisional Application Ser. Nos. 60/889,850, filed Feb. 14, 2007, 60/890,069, filed Feb. 15, 2007, 60/890,363, filed Feb. 16, 2007, 60/938,102, filed May 15, 2007, 60/941,852, filed Jun. 4, 2007, 60/945,444, filed Jun. 21, 2007, 60/953,421, filed Aug. 1, 2007, 60/954,248, filed Aug. 6, 2007, 60/969,043, filed Aug. 30, 2007, 60/980,682, filed Oct. 17, 2007, and 60/985,168, filed Nov. 2, 2007, all entitled "Sublimation Dye Printed Textile", which are incorporated herein by this reference.

FIELD OF THE INVENTION

The invention relates generally to sublimation dye printed textiles and particularly to sublimation dye printed textiles having the appearance of embroidery.

BACKGROUND OF THE INVENTION

Dye-sublimation printed appliqués have grown in popularity. In dye-sublimation printing, a dye-sublimation ink is held in a liquid solvent, such as water. To form a sublimation dye transfer, the dye-sublimation ink and solvent are applied to a donor material, a special type of paper, in the form of an image and dried. The dried sublimation dye transfer can be placed onto a material, such as a fabric, and heated; the heat transfers the image to the material. The final sublimation printed image is the reverse or mirror image of the image printed on the donor material. During the dye-sublimation process, the dye-sublimation ink is converted into a gas that permeates the fabric and solidifies within the fibers. The dye-sublimation inks can be quick-cure ultraviolet inks, solvent-based inks, and water-soluble, screen-printing inks.

Luster is an important visual aspect of a textile. Textile luster is substantially a surface phenomenon, produced when light impinging a surface is specularly reflected. High luster textiles are more preferred and difficult to achieve in many textile product applications. Dye printed textiles have been limited to low luster, tightly woven, smooth weaves. The present invention provides for textile products, more specifically woven textile products, with enhanced surface texture and luster having an embroidered appearance, and even more specifically a hand-stitched embroidered appearance.

SUMMARY OF THE INVENTION

In one embodiment, a design is provided that includes:

(a) a woven textile substrate having first and second opposing sides, the first side comprising dye sublimation particles to provide a desired image, wherein the image comprises printed stitching to create the impression that the design is embroidered; and (b) a backing adhesive positioned on the second side.

In another embodiment, a method includes the steps of:

(a) creating a digital image of a stitched design, the stitched image comprising imaged stitches; and (b) using the digital image, during sublimation printing, to create a representation of the digital image onto a woven textile.

Applicant unexpectedly and surprisingly developed high quality printed appliqués and transfers with the appearance of the texture and luster of hand-stitched embroidery and a method for making them. Applicant has found unexpectedly that sublimation dye printing of high luster fabrics, and more preferably of dimensionalized high luster fabrics, yields image quality, textural appearance, and luster of hand-stitched embroidery, heretofore unachievable in the textile dye print arts. The textile can be dimensionalized during or by a post weaving process or during the production of the textile patch or appliqué. Optimally, dimensionalization provides a textural appearance with a high degree of reflected light producing a lustrous affect.

The textile is preferably woven. Exemplary textiles include loosely or heavily woven polyesters with increased surface dimensionality or character. Sublimation dyeing of textiles has been traditionally practiced on substantially smooth (i.e., textiles with minimal surface texture or dimensionality) shiny textile fabrics. Sublimation dyeing of fabrics with a high degree of surface dimensionality and the openness of the weave are considered by those skilled in the art to be impractical. Surface dimensionality and/or openness is widely considered to degrade the quality of the sublimation dye image, thereby producing dithered and/or pixilated images. Applicant surprisingly overcame these challenges and others. The Applicant has found that high quality sublimation dye transfer images can be achieved with minimal dithering and/or pixilation on high loft, openly woven, dimensionalized fabrics with a surprisingly unexpected high degree of clarity and sharpness, equal to or better than, the same images on shiny, smoothly woven surfaces.

In yet another embodiment, a method includes the steps:

(a) bonding a thermosetting adhesive to a first surface of a textile, the thermosetting adhesive being A-staged;

(b) dimensionalizing a second side of the textile, while bonded to the thermosetting adhesive, to impart to the textile an embossed dimensionality; wherein the first and second surfaces are opposing, and (c) thermosetting the thermosetting adhesive to retain the embossed dimensionality of the textile.

Embossing can further enhance the illusion that the printed textile is hand or machine stitched. Because embossing can flatten the loft, tightness, and/or dimensionality of the weave in the textile, low pressures are used during embossing. To permit high pressures to be employed during sublimation printing, the thermosetting adhesive, during or after embossing, is cross-linked to "freeze" the fibers in the textile in a desired woven texture.

The present invention can provide a number of advantages depending on the particular configuration. For example, the use of a digital image captured from a stitched design can permit the dye sublimation printed (unstitched) design generated from the digital image to include realistic representations of the stitches—but at a fraction of the cost of hand or machine stitching. When the dye particles are transferred directly (e.g., by inkjet printing) or indirectly (e.g., by a transfer medium) onto a woven textile, the textile weave coupled with the stitch representations can provide a highly realistic, high resolution image having the appearance of a stitched or embroidered design. The embroidered look can be achieved by printing a high resolution image of the embroidered design and/or by printing on a coarse or loosely woven fabric. The design is a type of faux embroidery textile having great aesthetic appeal to customers. The design, preferably, uses polyester rather than nylon yarn and is therefore able to accept more readily dye particles. The design can be a heat seal product displaying a rich texture that is capable of being used for brilliantly colored printing. Compared to conventional embroidered designs, other potential advantages of the design include higher performance, lighter weight, finer design detail including four-color process, gradations and photo reproductions, faster application, less expensive, lower profile, less bulky, and reducing and/or eliminating puckering or itchy backing inside the garment.

These and other advantages will be apparent from the disclosure of the invention(s) contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The above-described embodiments and configurations are neither complete nor exhaustive. As will be appreciated, other embodiments of the invention are possible utilizing, alone or in combination, one or more of the features set forth above or described in detail below.

DETAILED DESCRIPTION

Figure 1A:
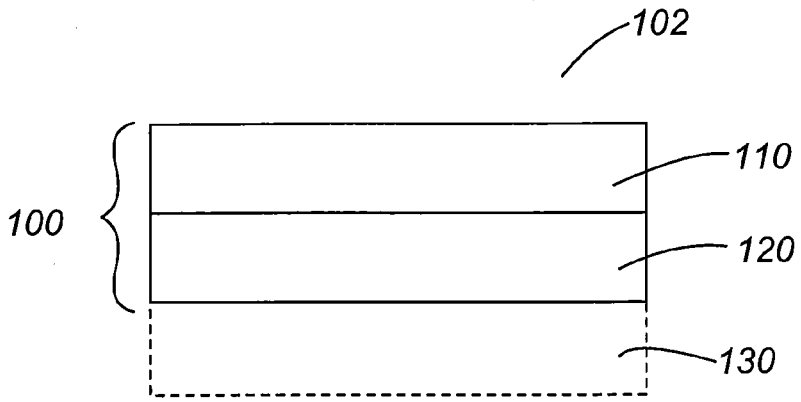
FIG. 1A is a side view of a textile design according to an embodiment.
Figure 1B:
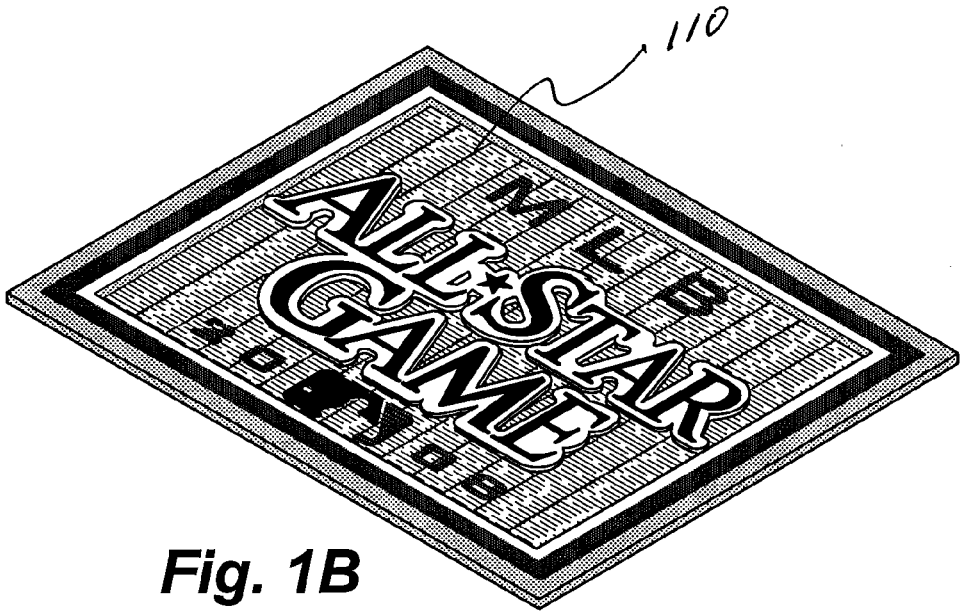
FIG. 1B is a plan view of the textile design.

An appliqué or heat transfer (hereinafter textile design) having the appearance of being embroidered or stitched will be described according to an embodiment of the present invention. With reference to FIGS. 1A and 1B, a textile design 100 includes a, preferably woven, textile 110, a thermosetting adhesive 120, and an optional backing material 130. As can be seen from FIG. 1B, the combination of a woven textile 110 and a digitally imaged embroidered, chenille, and/or stitched version of the same design can have a high degree of resemblance to the actual embroidered, chenille, or stitched design.

FIG. 1B is graphical depiction of the embroidered, hand-stitched appearance of the woven textile 110 and digitally printed "MLB", "2008", and Major League Baseball™ logo images. A highly accurate and high resolution digital image of the actual embroidered or stitched design is used to form a sublimation dye transfer. The dye transfer produces a high resolution sublimation printed image having the appearance of stitching in the woven textile 110 design. In one configuration, the woven textile imparts three-dimensional depth to the image. The combination of the woven textile 110 and sublimation printing process enhances the illusion of real embroidery and elevates the design to a higher level. The process generally can produce high resolution images, such as photographic quality images.

The artistic quality and presentational impact of the graphic image within the textile is dependent upon at least one or more of the textile weave, dimensionality (that is, level of embossment), and medium. Dimensionality means the quality of spatial extension, such as providing a realistic quality to which something extends, and within this specification refers to dimensionality of the woven textile and/or textile design. The type of weave can be important to the graphic image quality on the woven textile 110, since the graphic image is represented in light values (that is, relative degrees of lightness and darkness) and hues when the graphic image is a color image. The hue is primarily controlled by the dye and dye process, whereas the light value is primarily controlled by the weave and fibers (and/or yarns), more specifically by the relationship of the weave and/or fibers (and/or yarns) relative to the orientation of the viewer and light source.

A plethora of factors affect quantity of light reflected from a textile surface. The factors include: the chemical composition of the fiber, the degree of crystallity within the fiber, the diameter of the fiber, the fiber length, the cross-sectional shape of the fiber, the amount and type of twist within the fiber, the longitudinal shape of the fiber, the diameter of yarn, the orientation of the fibers within the yarn, the amount and type of twist of the yarn, the orientation of the yarns within the weave, the surface texture of the fiber and/or yarn, the structural relationship of weft to the warp (for example, but not limited to weave density, weave pattern, yarn and/or weave tension, weave pile, weave type (as for example, plain, twill, satin, tubular, cloth cylinder, double cloth, and looped)), and/or the length and density of the float within the weave.

The parameters defining a weave dimensionality are depicted in FIGS. 11-14.

Figure 11:
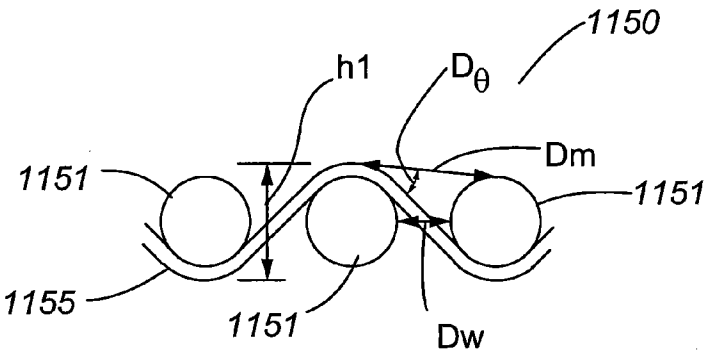
FIG. 11 is an exploded view of woven fibers according to an embodiment.

FIG. 11 depicts a textile weave 1150 having weft fibers 1151 and warp fibers 1155. In FIG. 11, $h_1$ is the loft or height of the textile weave, $D_w$ represents the tightness of the weave, and $D_m$ and $D_\Theta$ represent the dimensionality of the textile surface; $h_1$, $D_w$ $D_m$, and $D_\Theta$, can be important for the texture and reflectivity of the textile. While not wanting to be bound by any theory, the greater $h_1$ and/or $D_m$, and/or $D_w$ the more textured and open the textile and/or the more reflective the weave compared to a weave having smaller $h_1$, and/or $D_w$ and/or $D_m$ values. Or, stated another way, the Applicant unexpectedly found that more textured, open weaves are more reflective than less textured, tighter (or more closed) weaves.

In the textile fabric, hi is a measure of the warp weave height. $h_1$ can be expressed as the highest warp weave height, or average or weighted average of the wrap weave height, or as a statistical population or distribution function or value representing the warp weave height. The $D_w$ value is a measure of the looseness of the weft weave, the greater the $D_w$ value the looser the weft weave. $D_w$ can be expressed as the distance between neighboring weft fibers, or average or weighted average of the distance between neighboring weft fibers, or as a statistical population or distribution function or value representing the distance between neighboring weft fibers. The $D_m$ and $D_\Theta$ values are a measure of the dimensionality of the weave, the greater the $D_m$ value the greater the dimensionality of the weave; $D_\Theta$ also typically, but not always, increases with weave dimensionality. The $D_m$ and $D_\Theta$ values can be expressed as the distance and angle between weft and warp fibers as illustrated in FIGS. 11, 12, 13, and 14, or average or weighted average of the distance and angle between weft and warp fibers, or as a statistical population or distribution function or value representing the distance and angle between weft and warp fibers.

Figure 13:
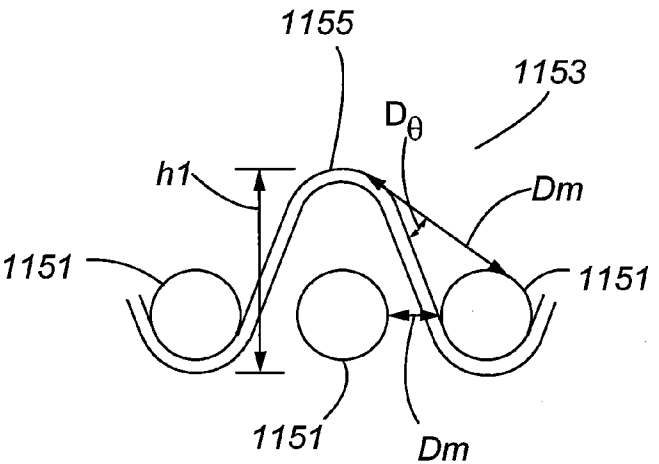
FIG. 13 is an exploded view of woven fibers according to an embodiment.

FIG. 13 depicts a loose, open, and textured textile weave 1153 with a higher degree of dimensionality than the textile weave depicted in FIG. 11, the looser weave of FIG. 13 provides for greater $h_1$, $D_w$, $D_m$ and $D_\Theta$ values and, therefore, for a greater loft, openness, and dimensionality. While not wanting to be bound by theory, textile weaves with greater $D_m$, $D_\Theta$ and $D_w$ values provide for more opportunities for light impinging the warp and weft fibers to be reflected off individual fibers (and/or yarns) and between neighboring fibers (and/or yarns); reflectivity increases with an increasing number of reflections. It is believed that highly reflective, textured surfaces provide for greater luminosity and a more valued product. It can be appreciated that, $D_\Theta$ depends on values of $h_1$, $D_m$, and the size of the weft fibers (or yarns).

In one configuration, the reflective properties of textile weave are determined by the reflective properties of the fibers and/or yarns comprising the weave as well as one or more of: i) the density of the weave (denser weaves with more warp and weft yarns (or fibers) per inch are more reflective due to the greater reflective surface density than coarser, less dense weaves having a smaller reflective surface weave density); ii) the variation in the amount of twist and/or tension within the yarn twist (a more highly twisted, thinner yarn has a smaller reflecting surface and is less reflective than thicker, less twisted yarn); iii) the type of weave (weaves having long weave segments reflect more light than smaller, more broken interlacing weaves, longer fibers and/or yarns provide for a greater, more organized reflective surfaces, as do weaves that present longer fiber and/or yarn segments within the weave, such as longer float weaves (as for example, satin, sateen, and damask weaves)); iv) the orientation of the viewer relative to the light source and yarns in the fabric weave (yarn floats orientated in front of (at a 90 degrees) the light source and viewer are more reflective than yarn floats orientated between the viewer (at 90 degrees) and the light source (at 270 degrees)); v) the direction of the yarn nap within the textile (typically a higher level of reflectance (or luster) is achieved when the fiber ends that comprise the yarn nap point away from the viewer than when the fibers ends of the nap point away from the viewer); and vi) the degree of inter-reflection (e.g., the feeling of greater color saturation due to the lowering of reflective light value observed in highly textured textile surfaces (due to the yarn and/or weave) arising from absorption of the impinging light as it is reflected back and forth among the fibers (and fiber naps) comprising the textile surface).

The textile 110 is preferably formed from polyester fibers or yarn and more typically is composed of shiny polyester "floss" yarns woven in a suitable weave. The polyester yarn is sublimation dye (also called disperse dye) transfer printable.

In one configuration, the preferred weave is a heavy-weave or one or more of a highly textured (or raised pattern), dimensionalized, loose (or open), and high loft. Such weaves are typically more lustrous, due to their increased reflectivity, than smoother, less dimensionalized weaves. Even more preferably, the woven textile 110 is a loosely woven polyester with increased surface dimensionality or character.

In one configuration, dimensionality and/or character is/are introduced to the weave by one or more of the following methods: 1) weaving the textile more loosely; 2) "crowding" the yarn during the weaving process; 3) "exaggerating" the weave; 4) weaving in an irregular pattern; 5) weaving or introducing after weaving a high dimensional profile; and/or 6) introducing surface "loops."

In one configuration, the woven textile 110 comprises a high luster yarn (or fiber) in a flat, smoothly woven type weave, such as, but not limited to satin type weaves with an interlacing float of at least 2 or to at least the following satin weave types commonly known within the art as:

a) Brocade—A brocade weave is a compound weave where a supplementary warp or filling yarn is inlaid into a base fabric to produce an embroidered appearance. (The supplementary or filling yarn is a yarn that can be removed without affecting the base fabric.) Brocade weaves can be continuous where the supplementary yarn floats on the back of the base fabric and is not visible on the fabric face, or discontinuous where the supplementary yarn is woven into the patterned areas visible on the fabric face.

b) Brocatelle—A brocatelle weave is a highly textured or high-relief motif produced with an additional yarn the runs between the fabric face and back to produce a pronounced texture, or dimensionality, or relief to the fabric surface. Brocatelle weaves are typically based on, but not limited to, satin weaves.

c) Camocas—A comocas fabric is typically a stain weave with a diapered design.

d) Crepe-back satin, Satin-back crepe, Crepe-satin, or Satin-crepe—These fabrics typically comprise a stain weave on the fabric face and a crepe crinkled affect produced by the weave, yarn or finishing technique on the back of the fabric. Typically weft crepe yarns are twisted and outnumber any supplemental or filling yarn by a factor of at least 2:1.

e) Duchesse—A duchesse weave is a high thread count satin weave, typically woven with fine yarns having a higher density of warp to weft yarns. Duchesse fabrics have a high luster and are highly textured and firm.

f) Satin—A warped-faced satin weave satin weave is a weave where warp yarns pass over multiple weft yarns before interlacing another waft yarn, or filling-faced satin weave where weft yarns pass over multiple warp yarns before interlacing another warp yarn. A satin weave produces a fabric surface where the warp and weft intersection points are as widely spaced as possible. Satins are typically woven with low twist filament yarns.

g) Double-face satin—A double-face satin has two satin constructions, one on the face and another on the back, produced by a weave having two warps and one weft.

h) Paillette satin—A paillette stain is a weave that produces a changeable color affect.

i) Peau de soie—A peau de soie stain weave can be of a single or double construction, typically characterized by a cross-rib texture in the weft direction and a slight luster.

j) Satin-back—A satin-back fabric is characterized by a weave and/or fabric on one side and any other weave or fabric on the opposing fabric side.

k) Satin foaconne—A stain foaconne is a slightly creped fabric with small designs.

l) Slipper satin—A slipper satin is a compact satin that can be brocaded.

m) Velvet satin—A velvet satin comprises a warp-pile satin weave with a short, dense cut pile. The pile consists of a looped yarn on the fabric surface; the loop can be produced by: 1) knotting the yarn at the base of the fabric; 2) weaving the yarn over wires to produce loops at the base of the fabric and cutting the loops to produce a cut pile; or 3) weaving the warp yarn to produce a double cloth and slicing the warp yarns positioned between the two opposing cloth surfaces to produce two cut-pile fabrics.

Although the textile 110 can be a non-woven fabric, this configuration is not preferred in most applications. For open areas with no ink, textured woven textiles look different and better (i.e., more embroidered). When used with flock, the woven textile can provide better adhesion to a hot melt-powdered adhesive on the bottom of a Lextra™ transfer. Stated another way, the woven textile provides for a good mechanical type of adhesion to the hot melt adhesive.

The thermosetting adhesive 120 is any suitable thermosetting adhesive. Examples of suitable adhesives include, without limitation, polyesters, polyamides, nylons, and mixtures thereof, with a polyester, nylon, or mixtures thereof being even more preferred. The thermosetting adhesive 120 is preferably a dry film thermosetting adhesive, such as, a cast or extruded A-staged film. Although the adhesive can be applied as a liquid, thermosetting adhesives applied as a liquid or in a wet form can be wicked by textile fibers (or yarns) by the liquid surface tension. This wicking can decrease the loft and/or dimensionality and/or openness of the textile weave by pulling the textile into the liquid adhesive or by pulling the warp and the weft fibers of the weave together, decreasing weave dimensionality, loft, and/or openness. In some cases, wicking can be so extreme that the liquid adhesive can wick through the entire thickness of the weave, that is, the liquid adhesive traverses the entire textile weave, thereby diminishing or destroying the dimensionality of the weave. In a preferred configuration, the thermosetting adhesive 120 is TSW-20™, a thermosetting adhesive, which can improve the heat-resistance and/or washing (laundry) resistance of the design. In one particular configuration, the washing resistance lasted at least about 100 wash cycles.

The method of manufacturing the textile assembly 100 (or optionally 102) will now be discussed.

Figure 2:
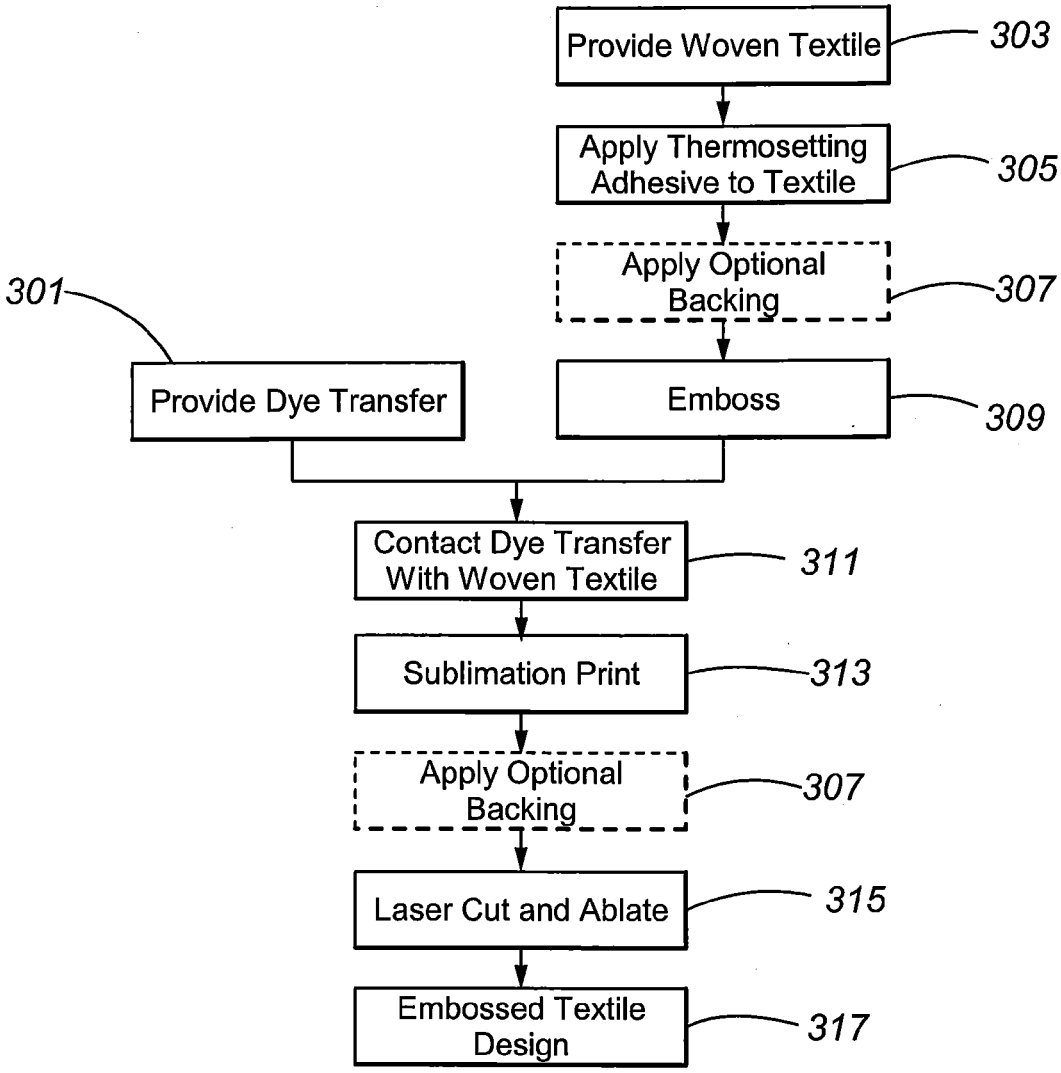
FIG. 2 is a manufacturing process according to an embodiment.

With reference to FIG. 2, in step 303, the woven textile 110 is provided, preferably not containing a printed image.

In step 305, the thermosetting adhesive 120 is applied to the woven textile 110 to form a textile assembly 100 (FIG. 1). The thermosetting adhesive 120 can be contacted as a liquid, solid or web adhesive. When the thermosetting adhesive 120 is a liquid, it can be sprayed, wet coated, or screen-printed onto one side of the woven textile 110. When the thermosetting adhesive 120 is a solid, it can be applied as a dry self-supporting film (such as, a continuous extruded film), a powder, or a web adhesive.

Step 305 can be performed in a laminating process, where heat and pressure are applied after, or substantially simultaneously with, contact of the thermosetting adhesive 120 with the woven textile 110. The thermosetting adhesive 120 is C-staged when embossing step 309 is not performed. When the embossing step 309 is to be performed, the thermosetting adhesive 120 can be A- and/or B-staged during step 305 while remaining at least partially uncured (that is, not substantially fully cross-linked or C-staged), fusible, and softenable when heated; that is, the thermosetting adhesive 120 remains A- and/or B-staged after the lamination process. As will be appreciated, the thermosetting adhesive 120, in the A- or B-stages, is only partially cross-linked, or is at least partly fusible. In this way, the thermosetting adhesive 120 substantially secures the woven textile 110 to the thermosetting adhesive 120, but substantially enough of the thermosetting adhesive 120 does not cross-link, or remains un-cured or un-cross-linked, so that the thermosetting adhesive 120 can be at a later time be further thermally and/or chemically fully cross-linked. In this manner, the thermosetting adhesive 120 can be fused (that is, can be reduced to a plastic state by heat) and does not resist mold-induced deformation in the embossing step.

The time, temperature, and applied pressure in step 305 is determined by the adhesive chemistry, its curing mechanism and/or process. The temperature is preferably below the cross-linking temperature of the thermosetting adhesive for a time sufficient to adhere the adhesive to the textile (which time typically is no more than about 2 minutes). Step 305 is preferably conducted at a sufficiently low pressure to maintain substantially most of the weave texture or dimensionality; that is, the pressure applied during step 305 preferably does not substantially degrade, damage, flatten, or distort the textile weave pattern or three-dimension weave character. To avoid over-compressing the woven textile 110, the laminating pressure applied typically is less than about 60 psi, even more preferably is no more than about 50 psi, and even more typically ranges from about 1 to about 30 psi. Commonly, the total applied pressure is at most about 8.5 lbs, even more commonly at most about 8.0 lbs, and even more commonly at most about 7.5 lbs.

In step 309, the textile assembly 100 (or optional textile assembly 102) is embossed. While not wanting to be bound by any theory, embossing introduces a further element of dimensionality and/or specular reflectance to the woven textile 110. The embossed woven textile 110 surface captures and reflects light to a greater degree, and, therefore, has a greater degree of luster.

Figure 3B:
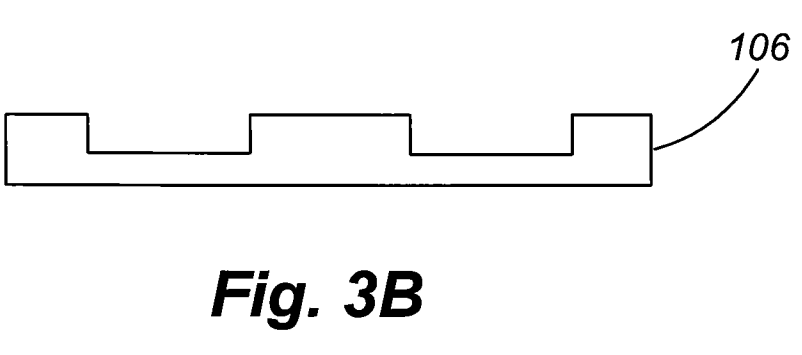
FIGS. 3A, 3B, 3C, and 3D are side views of textile designs according to another embodiment.
Figure 3D:
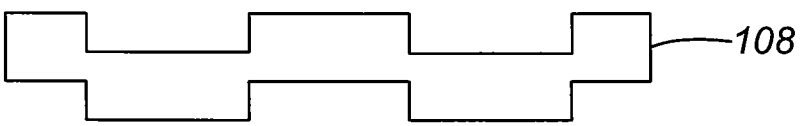
Figure 3A:
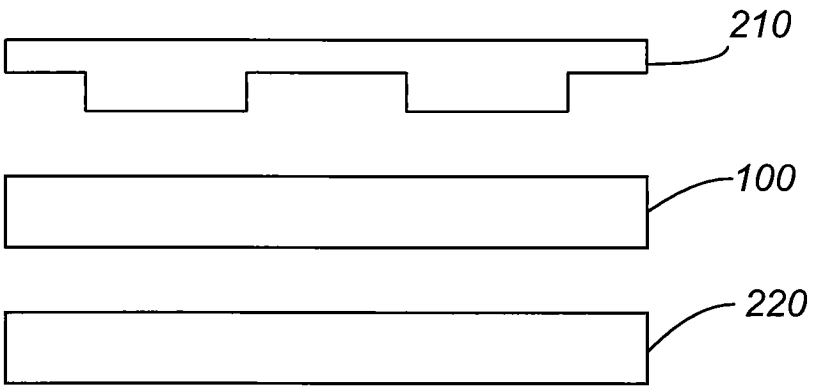
Figure 3C:
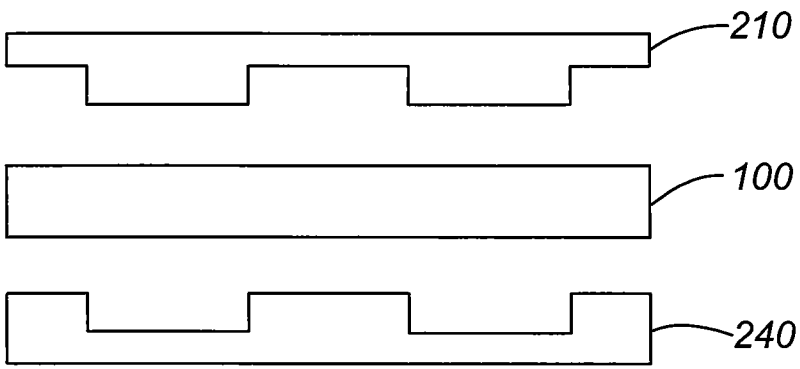

FIGS. 3A and 3C show a depiction of embossing dies 210, 220 and 240. Preferably, embossing is conducted with an embossing screen or belt for speed and ease of use. The dies 210 and 240 are articulated, interlocking (i.e. male and female) dies that can be used singly or as a pair. FIG. 3A depicts embossing the textile assembly 100 with the articulated embossing die 210 and the die 220, a flat die, to form an embossed assembly 106 (FIG. 3B). The articulated embossing die 210 can be above or below the flat die 220. Another method of embossing the textile assembly 100 is with male and female articulated embossing dies 210 and 240 (FIG. 3C) to form a second embossed assembly 108 (FIG. 3D). It can be appreciated that, the articulated embossing dies 210 and 240 can represent an embossing screen or belt, and the flat die 220 can represent a surface opposing the embossing screen or belt. It can be further appreciated that, the textile assembly 100 (or optional text assembly 102) is interposed between the embossing screen or belt and the opposing surface, and that pressure is applied to the textile assembly 100 by one or both of the opposing surface and/or embossing screen or belt.

In one embodiment, the frequency and/or periodicity of repeating pattern of the embossing dies 210 and/or 240 (or embossing screen or belt) differs from the frequency and/or periodicity of the weave pattern of the woven textile 110. The frequency or periodicity of the patterns in the embossing die and weave means frequency and periodicity of the raised and non-raised portions of the embossing die and weave, respectively. Preferably, the periodicities and/or frequencies of the patterns in the embossing die 210 and weave differ and/or are not harmonically related. Or stated another way, the pattern frequencies of the embossing die and weave are non-harmonic or out of alignment; that is, they are not related by an integer multiple of one of their periodic frequencies. Or stated yet another way, the periodic frequencies of the die and weave patterns are selected such that periodic frequency of the embossing die and weave patterns do not substantially superimpose one another. Preferably the embossing die frequency is about two-thirds (⅔) of, the periodicity of the weave pattern of the woven textile 110. Not withstanding the above, in one configuration enhancing the weave pattern is preferred by having the embossing die and weave pattern frequencies substantially about same, such that, the embossing step 309 enhances and/or increases the weave dimensionality. Or stated another way, raised and non-raised portions of the weave pattern and embossing die are contacted in registration to increase and/or enhance the weave dimensionality.

Heat is applied for a period of time during embossing step 309 to thermoset fully the thermosetting adhesive. The amount of heat applied is indicated by the temperature achieved in step 309. The temperature is at or above the cross-linking, or cure, temperature of the thermosetting adhesive 120. The time period is sufficient for substantial completion of the cross-linking reaction. Commonly, the temperature is at least about 100 degrees Celsius, more commonly ranges from about 125 to about 400 degrees Celsius, and even more commonly ranges from about 190 to about 350 degrees Celsius for a time typically of at least about 1 minute, more typically ranging from about 1.5 to 10 minutes, and even more typically ranging from about 2 to about 5 minutes. More typically, the thermosetting adhesive 120 is heated in step 305 at a temperature of about 150° C., or lower, to bond the adhesive to the textile and in step 309 at a temperature of about 195 to about 250° C. to fully crosslink the adhesive. In a particularly preferred configuration, the thermosetting adhesive 120 is B- and/or C-staged at a temperature of at least about 140° C. for no more than about 2 minutes.

By fully thermosetting the adhesive 120 during or after the embossing step 309, the embossed texture and textile weave are "frozen" in position. While not wishing to be bound by theory, once the thermosetting adhesive 120 is B- and/or C-staged, the woven textile 110 weave texture and/or dimensionality is essentially "frozen" in position and substantially resistant to pressure-induced distortions, flattening, or loss of dimensionality in processing steps 311, 313, 315 and the processing steps of FIG. 4, when compared to adhesive 120 being in the fusible or substantially un-cross-linked state. Or, stated another way, the B- and C-staging of the thermosetting adhesive 120 under low pressure to a highly texturized, high loft, open textile weave allows for the woven textile 110 to be adhered and locked in its high loft, open weave condition.

Figure 12:
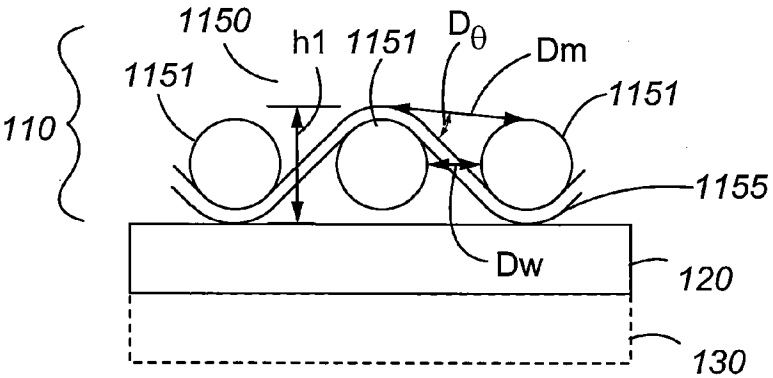
FIG. 12 is an exploded view of woven fibers according to an embodiment.
Figure 14:
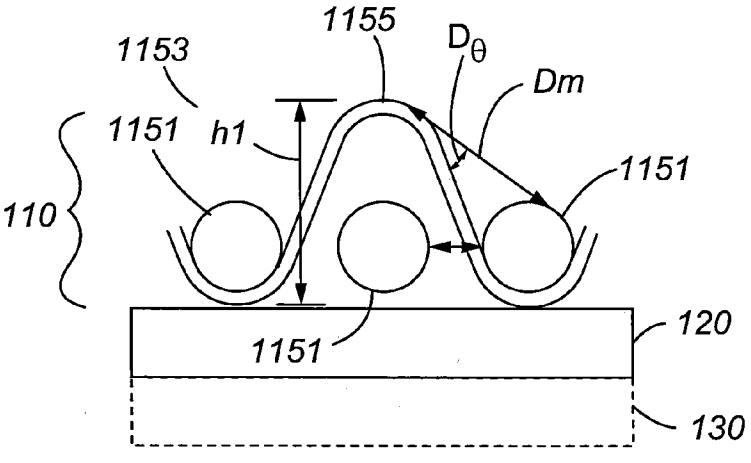
FIG. 14 is an exploded view of woven fibers according to an embodiment.

The applied pressure in step 309 is preferably sufficient to mold and/or form the thermosetting adhesive 120 but not too high to unacceptably flatten or distort the textile weave of woven textile 110. Stated another way, after cross-linking is completed, most, if not all, of the weave texture or dimensionality is maintained relative to the weave texture or dimensionality in the woven textile 110 before step 309. FIGS. 12 and 14 depict the weave texture or dimensionality of woven textile 110 weaves 1150 and 1153 being, respectively, maintained when adhered to the thermosetting adhesive 120 after any of steps 305, 307, 309, 309, and 313. In one embodiment, the weave character and dimensionality is at least about 75% retained through the process depicted in FIG. 2; that is, loft (or height), openness (or tightness or weft and warp spacing), and/or dimensionality of the woven textile 110 prior to contacting the thermosetting adhesive 120 is preferably at least about 75%, and even more preferably at least about 95% retained at the conclusion of the process steps depicted in FIG. 2. Stated another way, one or more of $h_1$, $D_m$, $D_w$, or $D_\Theta$ after any of steps 305, 307, 309, and 313 is preferably at least about 75%, and even more preferably at least about 95% of one or more of $h_1$, $D_m$, $D_w$ or $D_\Theta$ of the textile 110 in step 303. To produce these results, the applied pressure is quantitatively in the ranges provided above in the discussion of step 305.

In one configuration, an adhesive bond strength of the woven textile 110 to the thermosetting adhesive 120 is at least about 10 lbs (as measured on a standard peel test machine, such as, an Instron™ 3300, 5500, or 5800 series machine equipped for peel testing according any industry standard, such as, but not limited to, ASTM™ D-1781), with an adhesive bond strength of at least about 16 lbs. being more preferred. In an even more preferred configuration, the adhesive bond strength of the woven textile 110 to the thermosetting adhesive 120 is at least about 25 lbs.

In one embodiment, the thermosetting adhesive 120 is in the form of a moldable foam. The form is able to fill the voids in the adjacent textile surface caused by the embossed dimensionality, thereby providing a flatter, exposed adhesive surface. Preferably, the adhesive 120 includes foaming agents that, when activated, form a compression, moldable foam including a thermosetting adhesive components dispersed therein. The foaming agents are thermally activated, with the foaming temperature being in the thermosetting cure temperatures described above with reference to step 309.

In this configuration, the adhesive 120 is a liquid, paste or solid at ambient temperature, and impregnates the moldable foam as gas or liquid. In gaseous impregnation, the adhesive is vaporized and becomes entrained in the cellular structure of the foam as it condenses within and/or wets the cellular foam structure. In liquid impregnation, an impregnating liquid penetrates, wets and becomes entrained in the cellular structure of the foam. Preferably, the impregnating liquid has a surface energy value less than the foam and a viscosity such that the liquid can penetrate, wet, and be entrained in the foam. An impregnating solution can be a liquid adhesive, when the as-received, liquid adhesive is capable of penetrating, wetting, and being entrained in the foam. Commonly, an impregnating liquid comprises the as-received adhesive and a solvent, deposition aid, or a mixture thereof. A solvent means any organic or inorganic liquid substance or combination of liquid organic or inorganic substances capable of dissolving and/or dispersing the adhesive. A deposition aid is any substance or combination of substances alone or in combination with the solvent and the adhesive improves the penetrating, wetting, and/or entraining of the impregnating solution in the foam. The entrained solvent and/or deposition aid retained in the foam with the adhesive is removed, at least in part, by evaporation or stripping. The weight percent of adhesive entrained in the foam varies depending on the cellular structure of the foam, the composition of the foam, the adhesive density, and the adhesive loading of the foam. The weight percent can be as little as 1-2 wt % or as high as 95-99 wt % or any intervening value. In most instances, adhesive is retained on the exterior surfaces of the foam. Optionally, supplemental adhesive(s), the same as or different from the impregnated adhesive, may be contacted with and/or adhered to the one or more exterior surfaces of the foam.

In a preferred process configuration, the adhesive 120 is in the form of an open-cell foam made from melamine resin marketed by BASF under the registered trademarks BASOTECT® or BASOTECT®-TG. The compression, moldable foam commonly has a thickness range of about 1-300 mm, more commonly about 1-100 mm, and even more commonly about 3-10 mm; a bulk density range of about 5-15 kilograms per cubic meter and even more commonly 8-11 kilograms per cubic meter; a compressive stress at 10% strain of the moldable foam is about 2-30 kPa and even more commonly about 4-20 kPa; a maximum ram force of at least about 30 Newtons and even more commonly at least about 45 Newtons; tensile and compressive (at 40%) strengths of at least about 90 kPa and about 3-30 kPa, respectively, and even more commonly at least about 120 kPa and about 6-20 kPa, respectively; percent elongation at break value of at least 5% and more commonly at least about 10%; compressive strength of about 4-45% (23° C., 72 h, 50%) or 2-40 (70° C., 22h, 50%) and even more commonly about 10-35% (23° C., 72 h, 50%) or 5-30 (70° C., 22h, 50%); thermal conductivity at 10° C. and d=50 mm of at most about 0.05 W/mK and more commonly at most about 0.03 W/mK; diffusion resistance factor of about 1-3; length-specific flow-resistance of about 5-25 kNs/$m^4$; long-term service temperature of at least about 100° C. and more commonly at least about 150° C.; cell count of about 100-250 PPI and more commonly about 130-200 PPI; and a hardness (at 40% deformation prior to thermal molding) range of about 4-40 kPa.

As will be appreciated, embossing may be performed before, not only simultaneously with, thermosetting of the adhesive 120. The precise ordering of the two operations depends on the particular application.

While, not preferred, a thermoplastic adhesive can be used in place of the thermosetting adhesive 120 and may be applied before or after the sublimation printing step 313. The use of a thermoplastic adhesive in place of the thermosetting adhesive 120 would not, by its very nature, permanently lock the woven textile 110 in its high loft, open condition and can create problems in response to the high temperatures later used in sublimation printing. At these high temperatures, the adhesive can melt, thereby weakening the bond between the thermoplastic adhesive 120 and woven textile 110 and degrading and/or damaging the loft, dimensionality, and appearance of the woven textile.

When a thermoplastic adhesive is applied after the sublimation printing step 313, the adhesive preferably has a bonding or melt temperature less than the sublimation temperature of the dye particles in the ink to prevent re-mobilization of the dye particles and thereby preserve the integrity of the printed design,. In other words, the temperature at which a thermoplastic adhesive becomes tacky, or liquefies, is preferably less than the sublimation temperature. Otherwise, the dye particles will be re-mobilized when the design is heat bonded to a desired substrate. Preferably, the adhesive bonding temperatures are no more than about 80% and even more preferably no more than about 75% of the sublimation temperature. Stated another way, the thermoplastic adhesive bonding temperature is preferably no more than about 325 degrees Fahrenheit.

Figure 7:
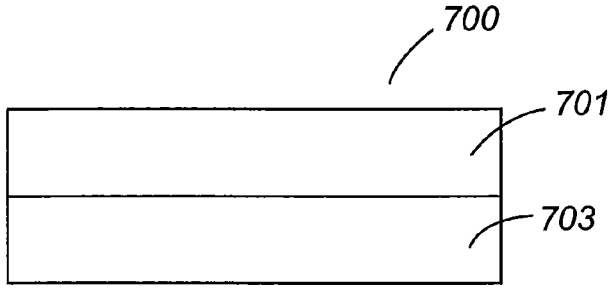
FIG. 7 depicts a dye transfer according to an embodiment.

In step 301, a sublimation dye transfer 700 (FIG. 7) is provided. As will be appreciated, sublimation involves the process of directly changing a solid substance to a gas or vapor phase, without first passing through an intermediary liquid phase. Sublimation dyes are heat-activated dyes that can change into a gas when heated and have the ability to penetrate and/or bond with certain substances. Sublimation dye-printed images are generally extremely scratch resistant and durable because the sublimation dye printed image is actually embedded in, and therefore protected by, the material on which the sublimation dye printed image is printed.

The sublimation dye heat transfer 700 is formed by known techniques from a digital image of an actual embroidered or stitched design, such as, an embroidered, chenille, and/or stitched version of the design. The digital image is routinely formed by scanning or photographing the embroidered or stitched design. The digital image may be modified, as desired, by using known imaging software. The dye transfer 700 includes a layer of ink 701 and a transfer medium 703. The digital image is printed onto the dye transfer medium 703 as a reverse or mirror image of the image that will be the graphic image sublimation printed on the textile. The transfer medium 703 may be a high quality ink jet paper, and the dye(s) used to print the image on the transfer medium 703 may be sublimation dye(s). The printing process can be any suitable printing process, preferably, by ink jet, screen, gravure, or digital printing. Preferably, the digital image is initially stored in the memory of a computer and printed onto the paper using an ink jet printer utilizing inkjet cartridges containing sublimation dye. Specifically, the ink jet printer may be an Epson Stylus Color 3000 ink jet printer, which is configured to use separate ink cartridges for the four main colors—cyan, magenta, yellow and black—and which can print photograph quality images. Sublimation dye print cartridges are generally commercially available. Alternatively, a color laser printer utilizing sublimation toner dyes can be used.

The ink can be any suitable ink formulation. The inks may be quick-cure ultraviolet inks, solvent-based inks (such as Proll or Noriphan™ HTR), and/or water-soluble inks.

In step 313, the side of the woven textile 110 opposing the side adhered to the B- or C-staged thermosetting adhesive 120 is contacted with the sublimation dye transfer 700, and the woven textile sublimation printed in response to application of heat and pressure for a determined period of time to form a printed image on the woven textile 110. In one configuration, sublimation printing is performed at a temperature of about 400° F. (204° C.) applied for a period of time ranging from about twenty seconds to about two minutes, and at a pressure ranging from about 3 to about 30 psi. Of course, other temperatures, times, and pressures can be used depending, for example, on the transfer medium 703, the woven textile 110 and/or the sublimation dyes. Applying heat and pressure to the dye transfer 700, causes at least a portion of the image printed on the dye transfer 700 to be transferred to the woven textile 110. When the dye transfer 700 is removed from the surface of the woven textile 110, the graphic image is visible on the woven textile surface and a "ghost image" (i.e. a washed out version of the printed mirror image) remains on the dye transfer 700.

While not wishing to be bound by any theory, it is believed that performing embossing step 309 and B- and C-staging the thermosetting adhesive 120 before the sublimation printing steps 311 and 313 permits higher pressures to be applied during sublimation printing step 313. The higher pressures can substantially flatten the raised and lowered weave portions of the embossed assembly 106 (or 108) to permit substantially even dye penetration and absorption. When the pressure is removed, the weave portion of the embossed assembly 106 (or 108) will return to its original three-dimensional relief due, in part, to the B- and/or C-staged thermosetting adhesive 120.

In one embodiment, the dye transfer 700 is applied in step 311 to either side of the woven textile 110 and sublimation printed (in step 313) prior to or simultaneous with step 303. In this embodiment, the woven textile side opposing the printed image side, or the woven textile side not contacted with the dye transfer 700, is contacted with the thermosetting adhesive 120 in step 305 and laminated thereto.

In another embodiment, the sublimation dye printing steps 311 and 313 may be conducted before the embossing step 309. For this embodiment to be practical, at least a portion of the thermosetting adhesive 120 remains uncured after the sublimation dye printing process 313. Otherwise, the thermosetting adhesive 120 will not be deformed and cross-linked during the embossing step 309. It may be possible, when sublimation dye printing step 313 is performed after or simultaneously with step 305, to only partially cross-link, or B- and/or C-stage, the thermosetting adhesive 120. While not wishing to be bound by any theory, it is believed that, in some cases, a partially cross-linked or B- and/or C-staged thermosetting adhesive 120 may still be deformable and permanently set to an infusible state during the later embossing step 309 provided that the thermosetting adhesive 120 can be still be C-staged, or substantially fully cross-linked, in step 309.

In another embodiment, steps 305, 309, 311, and 313 are performed concurrently in a single combined step.

In one embodiment, a tack adhesive is optionally used in step 311 during contact of the dye transfer 700 with the woven textile 110. Preferably, the contact adhesive is any type of release adhesive, that is, it does not permanently adhere the dye transfer 700 to the woven textile 110. The contact adhesive aids in maintaining the positioning of the dye transfer 700 on the woven textile 110. The contact adhesive can be a liquid or solid adhesive and is preferably, a non-permanent or temporary liquid or powdered (release) adhesive that can be applied to the dye transfer 700, woven textile 110, or both.

After sublimation printing step 313, optional step 307 may be performed. Prior to performing this step, the backing sheet (now shown) contacting the non-textile contacting side of the adhesive 120 is removed. In this step, an optional backing material 130 can be applied to the thermosetting adhesive 120 side of the textile assembly 100 to form optional textile assembly 102. Or, stated another way, in optional textile assembly 102, the thermosetting adhesive 120 is positioned between the woven textile 110 and optional backing material 130.

The optional backing material 130 can be any material, including, without limitation, a thermoplastic adhesive, an A-, B- or C-staged thermosetting adhesive, a web adhesive, a forming or resin molding backing material such as polycarbonate, a foam (which may be compressible and/or moldable), a permanently attached substrate, and combinations thereof. In one configuration, the material 130 is a thermoplastic adhesive, such as a polyurethane, co-polyurethane, polyester, co-polyester, polyamide, co-polyamide, polyolefin, and co-polyolefin. Unlike the thermosetting adhesive 120, the thermoplastic adhesive has a melting point below the sublimation temperature. The thermoplastic adhesive layer is therefore, preferably, applied after sublimation printing. The thermoplastic adhesive layer normally requires much less time than the thermosetting adhesive to adhere to a substrate. For example, the thermoplastic adhesive layer can be adhered to the thermosetting adhesive 120 in as little as 10-15 seconds. In another configuration, the material 130 is a hot-melt web adhesive. In another configuration, the material 130 is a heat seal backing adhesive. In yet another configuration, the material 130 is a forming material and the embossing step 309 a forming step, performed, for example, by thermoforming, vacuum forming, reforming, and hydro-forming techniques. The design is then used as a mold insert. In this configuration, the optional backing step 307 is performed before or simultaneously with step 309. In another configuration, the material is a substrate.

When step 307 is performed by laminating, the laminating pressure is commonly in the range of from about 1 to about 200 psi and even more commonly in the range of from about 1 to about 50 psi.

In step 315, the printed textile assembly is laser cut in step 315 to produce the embossed textile design 317 (which as noted may include additional layers of materials). The additional layer can be rubber or neoprene, for instance, and the embossed textile design 317 is used as a coaster, mat, or pad. In another configuration, no backing material is used, and the embossed textile design 317 is configured as a sew-on patch.

If the process is not terminated with the embossed textile design 317, step 315 can additionally include laser ablation. Laser ablation is a surface modification of the embossed assembly 106 (or 108) to facilitate adhesion of the embossed assembly 106 (or 108) to another adhesive, such as the adhesive of step 421, or optional step 429, of the process of FIG. 4. Preferably, the laser ablation burns a plurality of holes 501 in the embossed assembly 106 (or 108) as depicted in FIG. 5 (note, the embossment is omitted from FIG. 5 for simplicity of depiction). In a preferred embodiment, the laser ablation of the embossed assembly 106 (or 108) increases substantially the strength of the adhesive bond of the embossed assembly 106 (or 108) with another adhesive, for example, surface roughening can improve mechanical interlocking and/or wetting and spreading of the another adhesive with the embossed assembly 106 (or 108). Even more preferred are the laser ablation processes as disclosed by Abrams in co-pending U.S. patent application Ser. No. 11/874,146 with a filing Oct. 17, 2007, which is incorporated herein by this reference.

Figure 4:
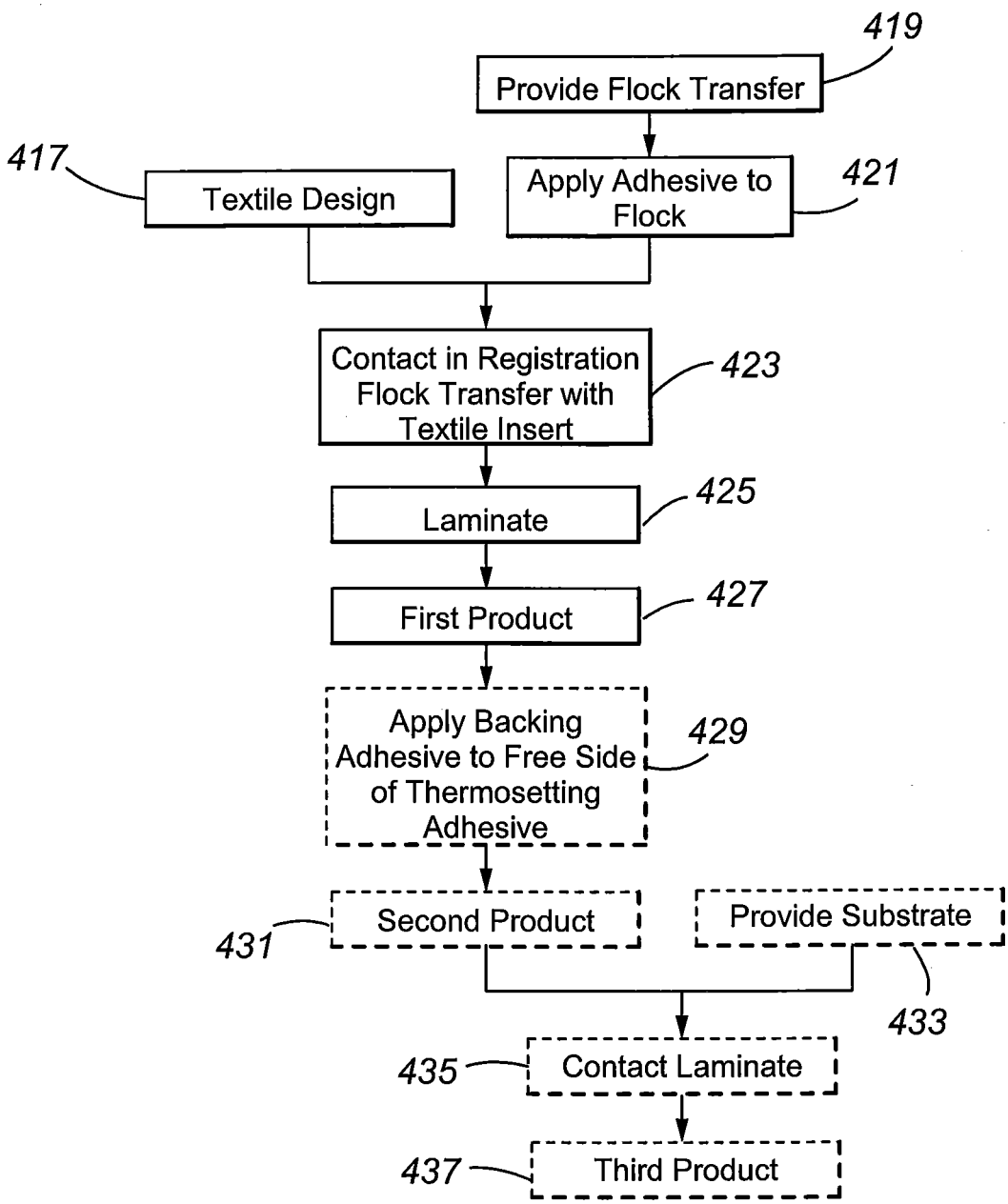
FIG. 4 is another manufacturing process according to another embodiment.
Figure 5:
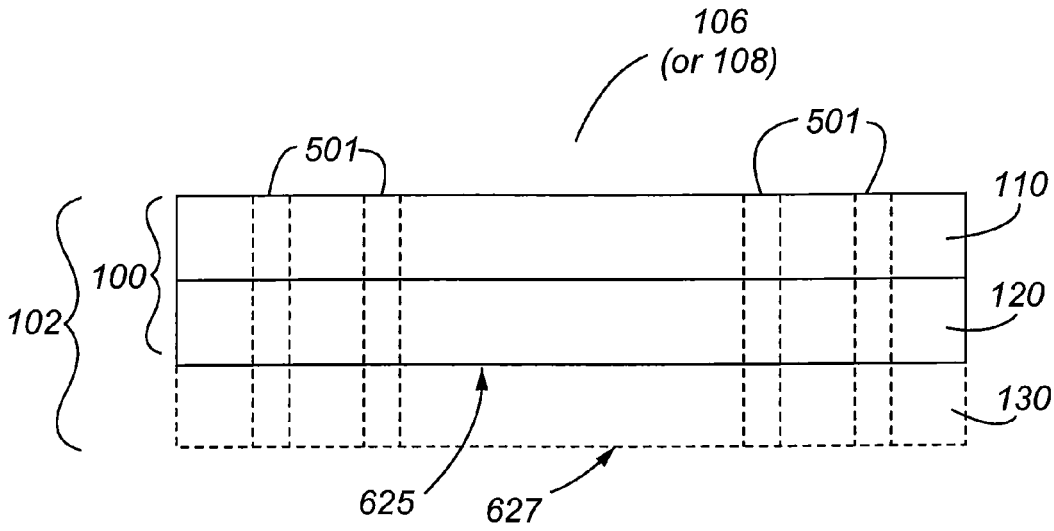
FIG. 5 is a side view of another textile design according to another embodiment.

Another embodiment of the invention is depicted in FIGS. 6A-G for adhering a textile design 417 to a flocked transfer 601 by the process represented in FIG. 4. The textile design 417 can be the embossed textile design 317. Additionally, it can be appreciated that, the textile design 417 can be in some configurations, cut by methods other than a laser, such as, but not limited to, mechanical or thermal cutting methods. It can also be appreciated that, the textile design 417 may or may not be laser ablated, mechanically, chemically, or thermally treated to improve bonding adhesion to adhesive 616. In one particular embodiment, the textile design 417 can be mechanically ablated by introducing a plurality of holes during embossing step 309. A plurality of needles and/or punches forms the plurality of holes.

In step 419, the flocked transfer 601 (FIG. 6A) is provided. The flocked transfer 601 is. comprised of a release sheet 610, release adhesive 611, plurality of flock fibers 612, and void 627. It is appreciated that, one of the void 627, embossed textile design 417 or both are configured and/or sized, such that the textile design 417 and void 627 match to properly display the textile design 417 when placed adjacent to the void 627. The first ends of the flock fibers are adhered to the release sheet 610 by the release adhesive 611.

In step 421, an adhesive 616 is applied to least most of the free ends of the plurality of flock fibers 612, the free ends opposing the first ends, are adhered to the release sheet 610. The adhesive 616 can be any adhesive, preferably, a thermosetting or thermoplastic adhesive. The adhesive can be a liquid, powder, web, or solid adhesive. When the adhesive 616 is a liquid, it can be sprayed, wet coated, or screen-printed on the free ends of the flock fibers 612. And, when the adhesive 616 is a solid, it can be one of a powder, web, or dry self-supporting film, such as, as a continuous extruded film. In a practically preferred embodiment, the adhesive 616 is a polyester or nylon adhesive. In particularly preferred embodiment, the adhesive 616 is a powdered, thermoplastic polyester adhesive applied to at least most, if not all, of the free ends of the flock fibers 612. When the adhesive 616 is a powder, it has a preferred powder size ranging from about 300 to about 400 microns. In another embodiment, the adhesive 616 is pre-cut, self-supporting adhesive film.

In step 423, the flocked transfer 601 with adhesive 616 and the textile design 417 are contacted in registration, such that, a contact area 629 having at least most, if not all, of the plurality holes 501, is contacted in registration with the adhesive 616. Additionally, the void 627 is in registration with at least most, if not all, of the sublimation printed graphic image of the textile design 417.

Figure 6A:
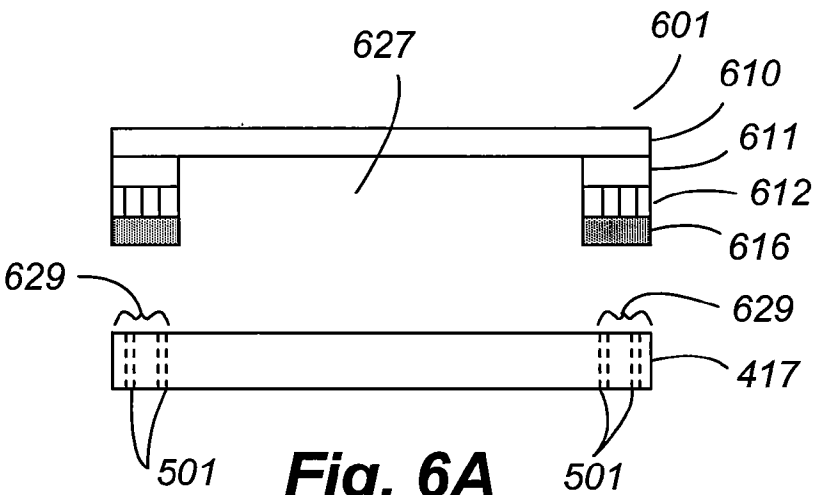
FIGS. 6A-G are designs according to other embodiments.
Figure 6C:
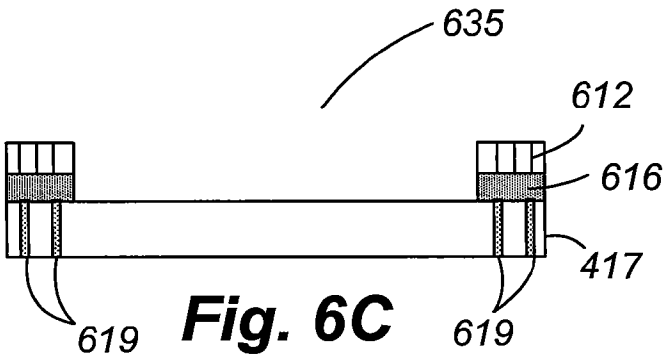
Figure 6B:
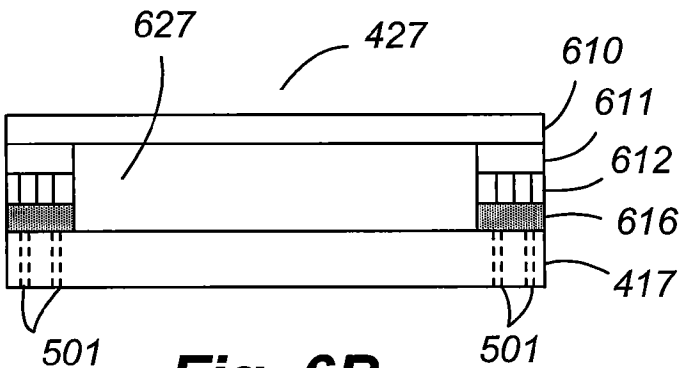
Figure 6E:
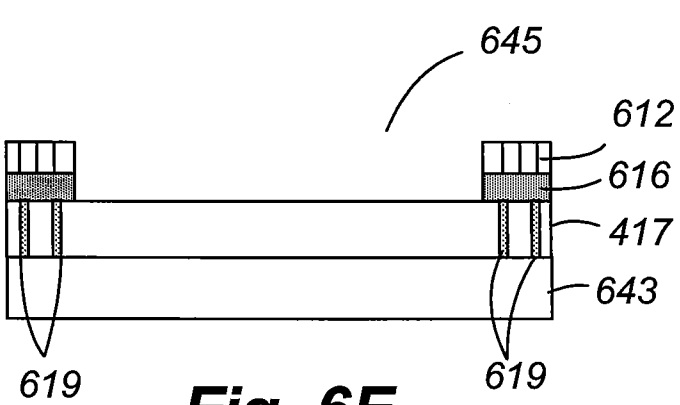

In step 425, the adhesive 616 is thermally bonded to the textile design 417 to form first product 427 (FIG. 6B). During the lamination step 425, the adhesive 616 is softened and/or partly liquefied and under the application of heat and pressure flows into the plurality of holes 501 filing the plurality of holes with adhesive 616 (shown in FIG. 6B as 619). It can be appreciated that, the woven textile 110 can be removed in selected areas of the contact area 629. While not wanting to be bound by theory, the plurality of holes 501 provide for enhanced adhesion by one or more of the following: mechanical interlocking of the adhesive 616 within the plurality of holes 501, and chemical and physical adhesive bonding by the adhesive 616 with the textile design 417 by one or more of: chemisorption, dispersive interactions, electrostatic interactions, and diffusion.

The release sheet 610 along with the associated release adhesive 611 can be peeled from the first product 427, to form a flocked product 635 (FIG. 6C) having a woven textile insert, which can, for example, be sewn onto a garment or other textile item.

In optional step 429, an adhesive backing 643 (FIG. 6D) is applied to surface 625 (FIG. 5) of adhesive 120, or to surface 627 when the optional backing material 130 is present. The adhesive backing 643 can be any adhesive, preferably, a liquid, web, or solid form of one of a thermosetting, thermoplastic, or multi-component adhesive thereof. Preferably, backing adhesive 643 is one of a solid web, dry self-supporting film (such as, as a continuous extruded film), or a multi-component adhesive film (such as, a bi-component adhesive film). In one embodiment, the adhesive 643 can be a polyester, nylon, or polyurethane adhesive. In another embodiment, the preferred backing adhesive 643 is a thermoplastic adhesive, preferably a soft rubber-like polyurethane, and more preferably a very soft, rubber-like polyurethane. Preferably, the backing adhesive 643 can be a non-woven web adhesive, more preferably a thermoplastic, no-woven web adhesive. Preferably, the web adhesive is one of a co-polyester, co-polyamide, polyolefin, or mixture thereof adhesive chemistry. The web adhesive can be contacted with surface 625 (or optional surface 627). Or, a thermoplastic polyurethane adhesive layer can be interposed between surface 625 and the web adhesive. In such a case, the backing adhesive 643 comprises a bi-component adhesive of the thermoplastic polyurethane and web adhesives. Wile not wanting to be bound by any theory, the thermoplastic polyurethane provides the unexpected advantage of keeping the thermoplastic web adhesive from flowing through the thermosetting adhesive 120 in certain instances. In yet another embodiment, the adhesive backing 643 is thermoplastic adhesive of about at most 1 mil thickness.

In another embodiment, the backing adhesive 643 is a foamable or foaming thermosetting adhesive. In other words, the backing adhesive 643 includes one or more foaming agents selected such that, when step 435 is performed, the backing adhesive 643 is simultaneously foamed. The foamed adhesive will expand into the voids created by the embossed design, thereby providing a relatively level lower backing adhesive 643 surface.

The surface 625 of the thermosetting adhesive 120 (or optional surface 627) of the textile design 417 (FIGS. 5 and 6A-G) can be treated to further facilitate adhesion. The plurality of holes 501 formed during laser ablation (in step 315) can extend entirely through the textile design 417 (that is, through woven textile 110 and adhesive 120) to facilitate adhesion of the backing adhesive 643 to the textile design 417. And, when the optional backing material 130 (not shown) is present between the adhesive 120 and the backing adhesive 643, the plurality of holes 501 can extend through the backing material 130 to facilitate the adhesion of the backing material 130 to the backing adhesive 643. Other treatment methods can be applied to the surface 625 (or the optional surface 627) to facilitate adhesion to the backing adhesive 643. These other methods to improve adhesion can be mechanical, chemical, or thermal treatments of the surface 625.

Figure 6D:
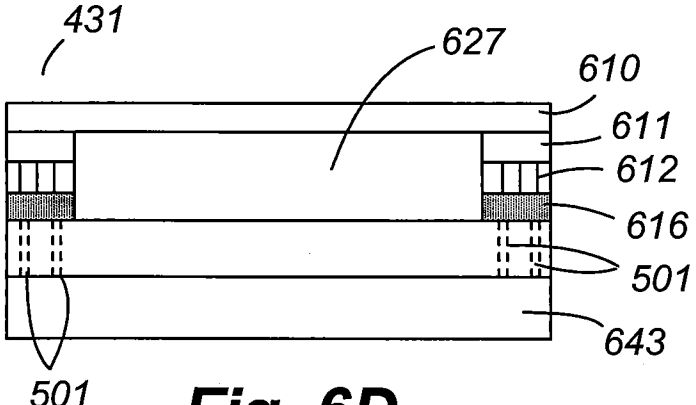

Returning to optional step 429, the backing adhesive 643 is contacted with the surface 625 (or the optional surface 627), and laminated with sufficient pressure and heat to cause the backing adhesive 643 to substantially flow. In can be appreciated that, the temperature and pressure required for the backing adhesive 643 to substantially flow depends on the chemical and physical properties of the backing adhesive 643. During lamination, the backing adhesive 643 can flow into the plurality of holes 501, the adhesive filling the plurality of holes 501, providing adhesion of the backing adhesive 643 to the thermosetting adhesive 120 of textile design 417 (or optionally to backing material 130) to form a second product 431 (FIG. 6D).

The release sheet 610 along with the associated release adhesive 611 (if still attached) can be peeled from the second product 431 to form another flocked product 645 (FIG. 6E) having a woven textile insert, which can, for example, be applied to a garment, other textile item, or other non-textile surface by sufficient heat and pressure to adhere (and/or bind) the adhesive backing 643.

Figure 6G:
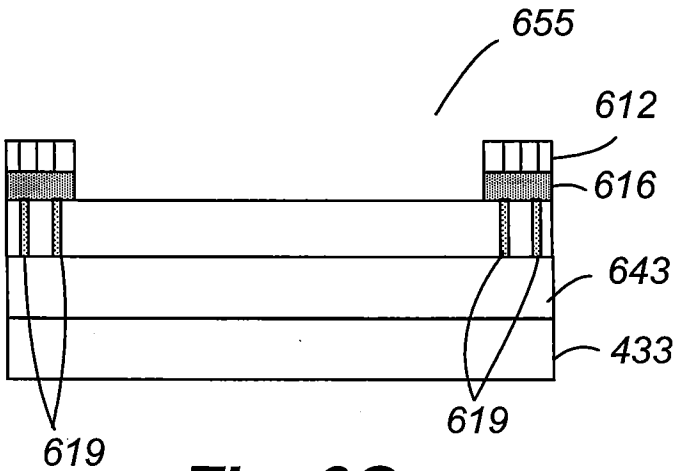
Figure 6F:
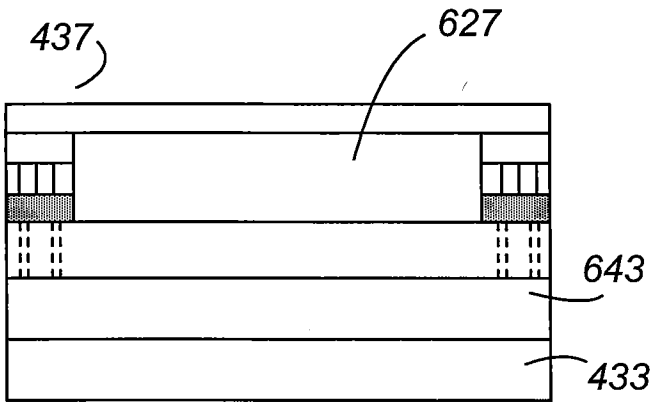

In step 435, a substrate 433 is provided and contacted with the second product 431. The substrate 433 can be substantially any hard or soft material that a thermoplastic adhesive can sufficiently adhere to. The substrate 433 can be, but is not limited, to any textile product, apparel (textile or non-textile), and/or consumer product (such as, automotive, electronic, computer, soft or hard goods, etc.). After and/or substantially simultaneous with contacting the second product 645 with the substrate 433, heat and pressure substantially sufficient to activate the adhesive backing 643 are applied to adhere the second product 645 to the substrate 433 to form a third product 437 (FIG. 6F). After adhering the second product 645 to substrate 433, the release sheet 610 and release adhesive 611 (if still attached) can be removed to form yet another flocked product 655 (FIG. 6G).

In one embodiment, steps 423 and 425 can be preformed substantially simultaneously to form the first product 427. Similarly, in another embodiment, steps 423, 425, and 429 can be preformed substantially simultaneously to form the second product 431. And, in yet another embodiment, steps 423, 425, 429, 433, and 435 can be preformed substantially simultaneously to form the third product 437. It can be further appreciated, that steps 429, 433, and 435 can be substantially preformed when the first product 427 is provided to form the third product 437.

Figure 8:
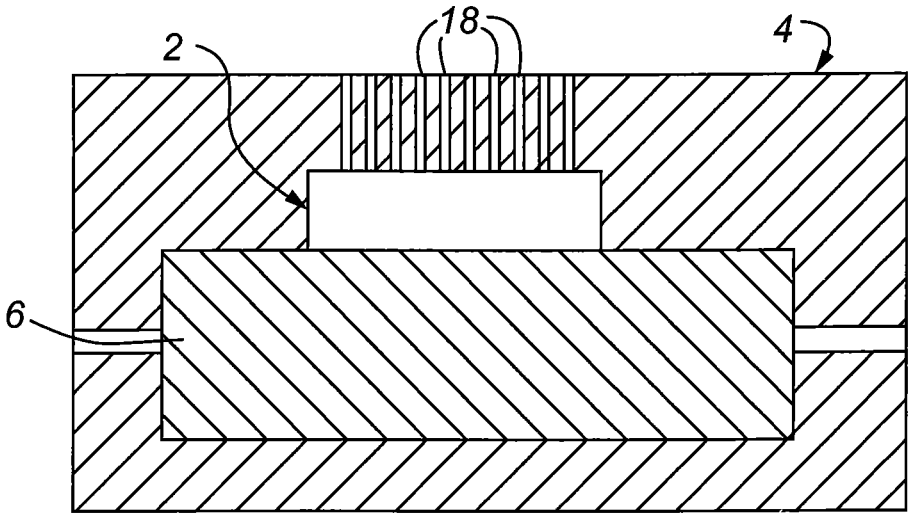
FIG. 8 depicts a cross-sectional view of a molding process according to an embodiment.
Figure 9:
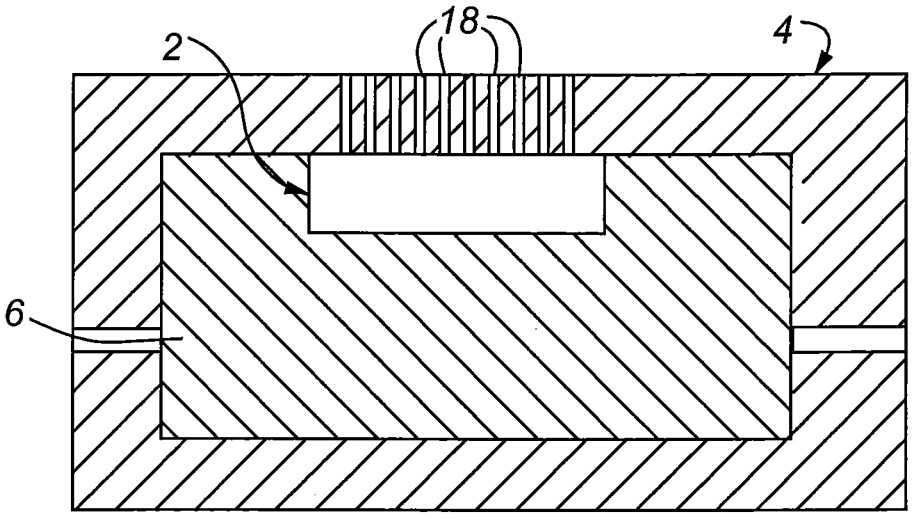
FIG. 9 depicts a cross-sectional view of another molding process according to another embodiment.
Figure 10:
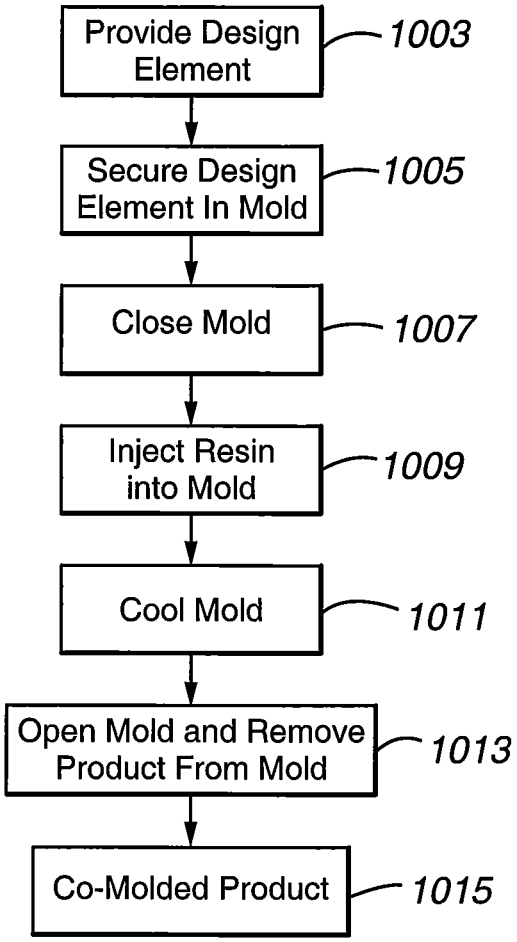
FIG. 10 depicts a manufacturing process according to yet another embodiment.

Another embodiment of the present invention is depicted in FIGS. 8, 9, and 10. A manufacturing process for a co-molded product 1015 having a design element 2 and a molded article 6 is depicted in FIG. 10. The design element 2 is provided for in step 1003 and mounted in a mold 4 in step 1005. FIG. 8 depicts a configuration where the design element 2 is on top of the molded article 6. In another configuration, depicted in FIG. 9, the design element 2 is embedded in the molded article 6. The design element 2 can be one of the embossed textile design 317, textile design 417, first product 427, second product 431, third product 437, or products 635, 645, or 655 that can be cut and/or fabricated to fit within the mold 4. More commonly, the design element 2 is the design 317 with a forming layer as the optional backing material 130.

The design element 2 can be secured in step 1005 within the mold 4 by any means, such as, but not limited to, a temporary or release adhesive, or as shown by the use of a vacuum. The mold 4 is depicted with vacuum holes 18 passing through the mold body and the design element 2 in contact with the vacuum holes 18. A vacuum can be drawn through the vacuum holes 18 to hold design element 2 in place within the mold 4. In another configuration, a low-pressure resin injection may be used secure the design element 2 in position; after securing the design element 2, a second full-pressure injection is made. In another configuration, a the mold 4 cavity can have a slight depression (of about 1 mm) to accommodate the design element 2, such that, the design element 2 is substantially flush with a surface of the molded article 6, as shown in FIG. 9.

After securing the design element 2 in the mold 4, the mold 4 is closed in step 1007 and a hot resin is injected into the mold 4 in step 1009. The method of molding can be any molding method, such as, but not limited to, injection, reaction injection, compression, transfer, and resin transfer molding. In a particularly preferred embodiment, the method of molding is reaction injection molding, wherein two base resins are mixed together as they enter the mold 4, a chemical reaction occurs within the mold 4 to form the molded article 6.

In step 1011, the mold 4 is cooled, after injecting the resin into the mold 4. The mold 4 can be cooled by any appropriate method known within the art. One preferred method for cooling is circulating water, either around the exterior or through the walls of the mold 4. The water can be circulated during or after the injection molding process.

As the resin cools, the resin permanently bonds with the design element 2 to form the co-molded product 1015. When the resin has sufficiently cooled and/or solidified the mold 4 is opened and the co-molded product 1015 is removed, in step 1013, from the mold 4. In instances where the design element 2 is the first 435, second 431, or third 437 product, the release sheet 610 and associated release adhesive 611 are removed from the co-molded product 1015.

In one configuration, the design element 2 is formed before molding. For example, embossed textile design 317, can be thermoformed during embossing step 309. Or, where the optional backing 130 has been applied, the textile design can be thermoformed after one of steps 313 or 315.

A number of variations and modifications of the invention can be used. It would be possible to provide for some features of the invention without providing others.

For example in one alternative embodiment, the design is used as an insert in a flocked design or transfer. Such transfers are described in U.S. Pat. No. 6,110,560; 5,346,746; and 5,207,851, each of which is incorporated herein by this reference. The insert is positioned in an unflocked part of the transfer such that the design is bordered by flock fibers.

In other embodiments, the dual use of a dye sublimation temperature-resistant adhesive with a later applied, non-dye-sublimation-temperature-resistant adhesive can be used for a myriad of other dye sublimation printed designs. The later applied adhesive can provide advantages generally to dye sublimation printed designs.

In yet another embodiment, a sublimation dye transfer process is provided that maintains a high degree of textile dimensionality during a sublimation dye transfer process. A low-pressure sublimation dye transfer process has been developed that produces sharp, clear images with intense color; one skilled in the art would expect image clarity and color intensity to decrease with decreases in dye transfer pressure. A preferred embodiment is a sublimation dye transfer process having a pressure of at most about 8.5 lbs. and more preferably at most about 8.0 lbs. and even more preferably at most about 7.5 lbs. A more preferred embodiment is a sublimation dye transfer process having a pressure of substantially at most about 8 lbs. on a clamshell dye transfer machine.

The present invention, in various embodiments, includes components, methods, processes, systems and/or apparatus substantially as depicted and described herein, including various embodiments, sub-combinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. The features of the embodiments of the invention may be combined in alternate embodiments other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations, combinations, and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An article, comprising:

(a) a woven polyester textile having first and second opposing sides, the first side comprising dye sublimation particles to provide a desired image;

wherein the woven polyester textile is textured to create an appearance that the desired image is embroidered in the absence of embroidery in the woven polyester textile and wherein the texture is defined by at least the following features:

(A1) shiny yarn fibers;

(A2) a weave in an irregular pattern; and (A3) a float within a yarn pattern defining at least one of a twill and satin weave type;

(b) a backing adhesive positioned on the second side, wherein an adhesive bond strength of the woven polyester textile to the backing adhesive of at least about 10 lbs (as measured on a standard peel test machine); and (c) flock bordering the woven polyester textile, wherein at least one of the following is true: (i) the flock is adhered to the woven polyester textile and (ii) the flock and woven polyester textile are adhered to a common substrate.

2. The article of claim 1, wherein the texture is defined by at least a satin weave type, wherein a filling yarn is inlaid into a base fabric of the woven polyester textile, wherein the float of at least portions of the satin weave type is an interlacing float of at least 2, and wherein the backing adhesive is a B- or C-staged thermosetting adhesive.

3. The article of claim 1, wherein the texture is defined by at least a satin weave type, wherein the float of at least portions of the satin weave type is an interlacing float of at least 2 and wherein the backing adhesive is a thermoplastic adhesive.

4. The article of claim 1, wherein the desired image comprises a digital image of actual embroidery, chenille, and/or stitching and wherein the woven polyester textile comprises at least one of brocade, brocatelle, camocas, crepe-back satin, duchese, satin, double-face satin, paillette satin, peau de soie, satin-back, satin foaconne, slipper satin, and velvet satin weave.

5. The article of claim 1, wherein the woven polyester textile is an insert and the flock is part of a flocked transfer, the flocked transfer has a void and the insert is received in the void, and wherein a second adhesive is in contact with the flock fibers and the backing adhesive, whereby the flock creates the illusion of depth.

6. The article of claim 1, wherein a quantity of light reflected from the woven polyester textile is controlled by at least one of:

a length and density of the float;

a loft or height of the woven polyester textile weave;

an amount of twist in the shiny yarn fibers;

a type of twist in the shiny yarn fibers; and a surface texture of the shiny yarn fibers and/or yarn.

7. The article of claim 6, wherein the quantity of light reflected from the woven polyester textile is controlled by the length and density of the float.

8. The article of claim 6, wherein the quantity of light reflected from the woven polyester textile is controlled by the loft or height of the woven polyester textile weave.

9. The article of claim 6, wherein the quantity of light reflected from the woven polyester textile is controlled by the amount of twist in the shiny yarn fibers.

10. The article of claim 6, wherein the quantity of light reflected from the woven polyester textile is controlled by the type of twist in the shiny yarn fibers.

11. The article of claim 6, wherein the quantity of light reflected from the woven polyester textile is controlled by the surface texture of the shiny yarn fibers and/or yarn.

12. The article of claim 1, wherein the texture is defined by at least a twill weave type.

13. The article of claim 1, wherein the yarn pattern is an open weave.

14. The article of claim 1, wherein the at least one of the twill and satin weave type is defined by surface loops in a warp fiber.

15. The article of claim 1, wherein the yarn pattern has a dimensional profile from an embossing die.

16. The article of claim 15, wherein at least one of a periodicity and frequency of application of a repeating pattern on the embossing die is different from the at least one of periodicity and frequency of the at least one of the twill and satin weave type.

17. The article of claim 15, wherein the embossing die is applied in a different frequency and/or periodicity than the weave in the irregular pattern.

18. The article of claim 1, wherein the adhesive bond strength is at least about 16 lbs.

19. The article of claim 1, wherein the adhesive bond strength is at least about 25 lbs.

20. The article of claim 1, wherein the backing adhesive has a diffusion resistance factor in the range of about 1 to about 3.

21. The article of claim 1, wherein the backing adhesive has a specific flow resistance in the range of about 5 to about 25 $kNs/M^4$.

22. The article of claim 1, further comprising a second backing adhesive material engaging the woven polyester textile and flock.

23. The article of claim 4, wherein the weave is a crepe-back satin weave and wherein weft crepe yarns outnumbers supplemental filling yarns by a factor of at least 2:1.

24. An article, comprising:

(a) a woven polyester textile having first and second opposing sides, the first side comprising dye sublimation particles to provide a desired image;

wherein the woven polyester textile is textured to create an appearance that the desired image is embroidered in the absence of embroidery in the woven polyester textile and wherein the texture is defined by at least the following features:

(A1) shiny polyester floss yarn fibers;

(A2) a float within a yarn pattern defining a twill weave type; and (A3) a weave woven in an irregular pattern;

(b) a backing adhesive positioned on the second side, wherein an adhesive bond strength of the woven polyester textile to the backing adhesive of at least about 10 lbs (as measured on a standard peel test machine);

(c) flock bordering the woven polyester textile; and (d) an adhesive backing contacting the flock and backing adhesive.

25. The article of claim 24, wherein the texture is further defined by the yarn pattern having a weave design that repeats over the first side of the woven polyester textile, the repeating weave design having an irregular spatial yarn pattern.

26. The article of claim 25, wherein a quantity of light reflected from the woven polyester textile is controlled by at least one of:

a length and density of the float;

a loft or height of the woven polyester textile weave;

an amount of twist in the shiny polyester floss yarn fibers;

a type of twist in the shiny polyester floss yarn fibers; and an orientation of the shiny polyester floss yarn fibers within the weave design;

a surface texture of the shiny polyester floss fibers and/or yarn.

27. The article of claim 26, wherein the irregular weave design is defined by the length and density of the float.

28. The article of claim 26, wherein the quantity of light reflected from the woven polyester textile is controlled by the loft or height of the woven polyester textile weave.

29. The article of claim 26, wherein the quantity of light reflected from the woven polyester textile is controlled by the amount of twist in the shiny polyester floss yarn fibers.

30. The article of claim 26, wherein the quantity of light reflected from the woven polyester textile is controlled by the type of twist in the shiny polyester floss yarn fibers.

31. The article of claim 26, wherein the quantity of light reflected from the woven polyester textile is controlled by the surface texture of the shiny polyester floss fibers and/or yarn.

32. The article of claim 25, wherein the yarn pattern is an open weave.

33. The article of claim 25, wherein the weave design is defined by surface loops in a warp fiber.

34. The article of claim 25, wherein the yarn pattern has a dimensional profile from an embossing die and wherein the adhesive bond strength of the woven polyester textile to the backing adhesive is at least about 16 lbs (as measured on a standard peel test machine).

35. The article of claim 25, wherein at least one of a periodicity and frequency of application of a repeating pattern on the embossing die is different from the at least one of periodicity and frequency of the weave design.

36. The article of claim 34, wherein the embossing die is applied in a different frequency and/or periodicity than the weave of the irregular pattern.

37. The article of claim 24, wherein the adhesive bond strength is at least about 25 lbs.

38. The article of claim 24, wherein the backing adhesive has a diffusion resistance factor in the range of about 1 to about 3.

39. The article of claim 24, wherein the backing adhesive has a specific flow resistance in the range of about 5 to about 25 kNs/$M^4$.

40. The article of claim 24, wherein the desired image comprises a digital image of actual embroidery, chenille, and/or stitching.

41. The article of claim 24, wherein at least one of the following is true: (i) the flock is adhered to the woven polyester textile and (ii) the flock and woven polyester textile are adhered to a common substrate.

42. An article, comprising:

(a) a woven polyester textile having first and second opposing sides, the first side comprising dye sublimation particles to provide a desired image;

wherein the woven polyester textile is textured to create an appearance that the desired image is embroidered in the absence of embroidery in the woven polyester textile and wherein the texture is defined by at least the following features:

(A1) shiny polyester yarn fibers;

(A2) a float within a yarn pattern defining a satin weave type; and (A3) a filling yarn inlaid into a base fabric of the woven polyester textile;

(b) a backing adhesive positioned on the second side, wherein an adhesive bond strength of the woven polyester textile to the backing adhesive of at least about 10 lbs (as measured on a standard peel test machine);

(c) flock bordering the woven polyester textile; and (d) an adhesive backing contacting the flock and backing adhesive.

43. The article of claim 42, wherein the float of at least portions of the yarn pattern is an interlacing float of at least 2 and wherein the texture is further defined by the yarn pattern having a weave design that repeats over the first side of the woven polyester textile, the repeating weave design having a irregular spatial yarn pattern.

44. The article of claim 42, wherein the adhesive bond strength of the woven polyester textile to the backing adhesive is at least about 16 lbs (as measured on a standard peel test machine) and wherein the desired image comprises a digital image of actual embroidery, chenille, and/or stitching and wherein the woven polyester textile comprises at least one of brocade, brocatelle, camocas, crepe-back satin, duchese, satin, double-face satin, paillette satin, peau de soie, satin-back, satin foaconne, slipper satin, and velvet satin weave.

45. The article of claim 43, wherein a quantity of light reflected from the woven polyester textile is controlled by at least one of:

a length and density of the float;

a loft or height of the woven polyester textile weave;

an amount of twist in the shiny polyester yarn fibers;

a type of twist in the shiny polyester yarn fibers; and an orientation of the shiny polyester yarn fibers within the weave design;

a surface texture of the shiny polyester yarn fibers and/or yarn.

46. The article of claim 45, wherein the quantity of light reflected from the woven polyester textile is controlled by the length and density of the float.

47. The article of claim 45, wherein the quantity of light reflected from the woven polyester textile is controlled by the loft or height of the woven polyester textile weave.

48. The article of claim 45, wherein the quantity of light reflected from the woven polyester textile is controlled by the amount of twist in the shiny polyester yarn fibers.

49. The article of claim 45, wherein the quantity of light reflected from the woven polyester textile is controlled by the type of twist in the shiny polyester yarn fibers.

50. The article of claim 45, wherein the quantity of light reflected from the woven polyester textile is controlled by the surface texture of the shiny polyester yarn fibers and/or yarn.

51. The article of claim 45, wherein the yarn pattern is an open weave.

52. The article of claim 45, wherein the weave design is defined by surface loops in a warp fiber.

53. The article of claim 45, wherein the yarn pattern has a dimensional profile from an embossing die.

54. The article of claim 53, wherein at least one of a periodicity and frequency of application of a repeating pattern on the embossing die is different from the at least one of periodicity and frequency of the weave design.

55. The article of claim 54, wherein the embossing die is applied in a different frequency and/or periodicity than the irregular spatial yarn pattern.

56. The article of claim 42, wherein the adhesive bond strength is at least about 25 lbs.

57. The article of claim 42, wherein the backing adhesive has a diffusion resistance factor in the range of about 1 to about 3.

58. The article of claim 42, wherein the backing adhesive has a specific flow resistance in the range of about 5 to about 25 kNs/$M^4$.

59. The article of claim 42, further comprising a second backing adhesive material engaging the woven polyester textile and flock.

60. The article of claim 44, wherein the woven polyester textile comprises a crepe-back satin weave and wherein crepe weft yarns outnumbers supplemental filling yarns by a factor of at least 2:1.

61. The article of claim 42, wherein at least one of the following is true: (i) the flock is adhered to the woven polyester textile and (ii) the flock and woven polyester textile substrate are adhered to a common substrate.

* * * * *